US008307913B2

(12) United States Patent
Dolman et al.

(10) Patent No.: US 8,307,913 B2
(45) Date of Patent: Nov. 13, 2012

(54) DRILLING SYSTEM WITH DRILL STRING VALVES

(75) Inventors: Lee F. Dolman, Naucalpan de Juarez (MX); Benjamin P. Jeffryes, Histon (GB); Ashley B. Johnson, Milton (GB); Brian Clark, Sugar Land, TX (US); John A. McCullagh, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/113,539

(22) Filed: May 1, 2008

(65) Prior Publication Data

US 2009/0272580 A1 Nov. 5, 2009

(51) Int. Cl.
*E21B 21/08* (2006.01)
*E21B 21/10* (2006.01)

(52) U.S. Cl. ..... 175/38; 175/57

(58) Field of Classification Search ..... 175/38, 175/48, 317, 320; 73/152.43
See application file for complete search history.

(56) References Cited

U.S. PATENT DOCUMENTS 2,128,352 A * 8/1938 Creighton ..... 175/65
3,005,507 A * 10/1961 Clark, Jr. et al. ..... 175/324
3,595,075 A * 7/1971 Dower ..... 73/152.19
4,253,530 A * 3/1981 Sharki et al. ..... 175/25
4,310,050 A * 1/1982 Bourgoyne, Jr. ..... 166/318
4,310,058 A * 1/1982 Bourgoyne, Jr. ..... 175/48
4,406,335 A * 9/1983 Koot ..... 175/317
4,553,226 A 11/1985 Scherbatskoy
4,645,006 A * 2/1987 Tinsley ..... 166/374
4,867,254 A * 9/1989 Gavignet ..... 175/48
5,070,949 A * 12/1991 Gavignet ..... 175/48
6,176,323 B1 * 1/2001 Weirich et al. ..... 175/40
6,443,240 B1 9/2002 Scott
6,802,373 B2 * 10/2004 Dillenbeck et al. ..... 166/255.1
7,027,968 B2 * 4/2006 Choe et al. ..... 703/10
7,138,929 B2 11/2006 Jeffryes et al.
7,696,900 B2 * 4/2010 Hall et al. ..... 340/853.7
2002/0112888 A1 * 8/2002 Leuchtenberg ..... 175/48
2003/0029611 A1 * 2/2003 Owens ..... 166/250.03
2006/0225926 A1 10/2006 Madhavan et al.
2008/0029306 A1 * 2/2008 Krueger et al. ..... 175/210
2010/0193184 A1 * 8/2010 Dolman et al. ..... 166/253.1

OTHER PUBLICATIONS

Merriam-Webster Dictionary definitions of "Diffuse" and "Particle", accessed Dec. 9, 2010 at merriam-webster.com.*
Miska, Beck & Murugappan, "Computer Simulation of the Reverse-Circulation Well-Control Procedure for Gas Kicks" Dec. 1992, published in the SPE Drilling Engineering journal.*
Schlumberger's Oilfield Glossary entry for "drillstring" as it appeared on Oct. 17, 2006; Accessed via www.archive.org.*

* cited by examiner

*Primary Examiner* — Daniel P Stephenson
*Assistant Examiner* — Blake Michener
(74) *Attorney, Agent, or Firm* — Kimberly Ballew; John Vereb

(57) ABSTRACT

A method to control borehole fluid flow includes detecting a drilling condition and operating at least one valve in the drill string to place an exterior of the drill string in fluid communication with an interior of the drill string in response to detecting the drilling condition.

15 Claims, 20 Drawing Sheets

DRILLING SYSTEM WITH DRILL STRING VALVES

BACKGROUND OF THE INVENTION

A typical drilling system for use in drilling for oil, gas, and other hydrocarbons includes: a drilling rig, a drill string having its upper end mechanically coupled and suspended from the drilling rig, and a bottom hole assembly ("BHA") mechanically coupled to the lower end of the drill string. The drill string is typically made up of segments of drill pipe that are coupled together, end-to-end, to form a long pipe string. The BHA typically includes a drill bit at its lower end. Wired drill pipe is an emerging technology that may be used to provide communication and power distribution throughout the drilling system. For example, wired drill pipe may be used to transmit data from a measuring device in the BHA to an uphole processor system. In other examples, wired drill pipe may be used to transmit data or instructions from an uphole system to the BHA. In addition, wired drill pipe may provide communications to and from sensors or other electronics positioned at points along the drill string. Wired drill pipe may be used to transmit power through portions of the drill string as well.

In a drilling system, a drilling fluid, called "mud," is typically pumped from the surface, through the drill string to the drill bit. The mud exits through ports in the drill bit, where it cools and lubricates the drill bit and cleans away the drill cuttings from the bottom of the borehole. Additional tools near the bit (including, for example, motors, underreamers, rotary steerable system, measurement-while-drilling ("MWD") tools, or logging-while-drilling ("LWD") tools) may divert a proportion of the fluid flow out to the annulus close to the bit, but the majority of the flow will pass through the bit. In offshore drilling, there may also be an additional flow path of fluid to a riser annulus through a riser boost system. The control from the surface of the fluid flow that exits through the bit and different means is very limited.

A method to control the flow in and around the drill system of the drilling fluid during operation would be beneficial, including during well-control situations.

SUMMARY OF THE INVENTION

In one aspect, a drilling system includes a drill string and a plurality of valves located in the drill string, wherein the valves are in fluid communication with an interior of a drill string and the exterior of the drill string.

In another aspect, a method to control borehole fluid flow includes detecting a drilling condition and operating at least one valve in the drill string to place an exterior of the drill string in fluid communication with an interior of the drill string in response to detecting the drilling condition.

In another aspect, a method of controlling fluid flow in a borehole includes detecting an influx of formation fluids into the borehole, circulating mud through the borehole, position the influx proximate a drill string valve, opening the drill string valve, allowing drill pipe pressure and casing pressure to equalize, shutting the valve, circulating mud until influx removed, and circulating kill mud in accordance with Driller's Method.

In another aspect, a method for controlling fluid flow in a borehole includes detecting an influx of formation fluids into the borehole, circulating mud in the borehole, position the influx above a drill string valve, opening the drill string valve, reverse circulating the influx into the drill string through the valve, closing the valve, reverse circulating down annulus to circulate influx to surface through drill string, shutting in the borehole, lining up casing to the choke valve, and circulating a kill mud.

In another aspect, a method for controlling fluid flow in a borehole includes detecting an influx of formation fluids into the borehole, calculating a migration of the influx and a displacement of a kill mud, circulating kill mud down the drill pipe until the kill mud occupies a position in the drill string that is lower than a position of the influx in an annulus, opening at least one drill string valve, and displacing kill mud into the annulus.

In another aspect, a method of controlling fluid flow in a borehole includes detecting a lost circulation, locating a lost circulation zone, opening at least one drill string valve, and pumping a lost circulation material through a drill string and out the at least one drill string valve.

In another aspect, a method of operating a valve in a drill string includes releasing a magnetic material in a drilling fluid flow in a drill string, passing the magnetic material through a coil operatively coupled to the valve, wherein the magnetic material passing though the coil generates electricity to power the valve.

In another aspect, a method of cleaning a borehole includes determining a location of a cuttings bed, positioning a drill string valve proximate the cuttings bed, and opening the drill string valve to allow fluid flow to pass from a drill string to an annulus, proximate the cuttings bed.

DETAILED DESCRIPTION

Hydraulics in conventional drilling requires balancing different requirements. For instance, the fluid flow velocity in the widest section of the annulus must be sufficient to lift cuttings, but the pressure drop in the drillpipe must be within the pump capabilities. Furthermore, the flow velocity in the narrowest part of the annulus should not be so high as to cause erosion or hole widening. Downhole equipment, such as positive displacement motors, turbines and rotary steerable systems also have flow ranges within which they operate. Attempting to reconcile these different requirements may be difficult or even impossible in conventional systems. Allowing some of the flow to exit the drillstem at chosen points, when desired, allows the various requirements to be reconciled much more easily, and adds considerable flexibility to the driller.

Figure 1:
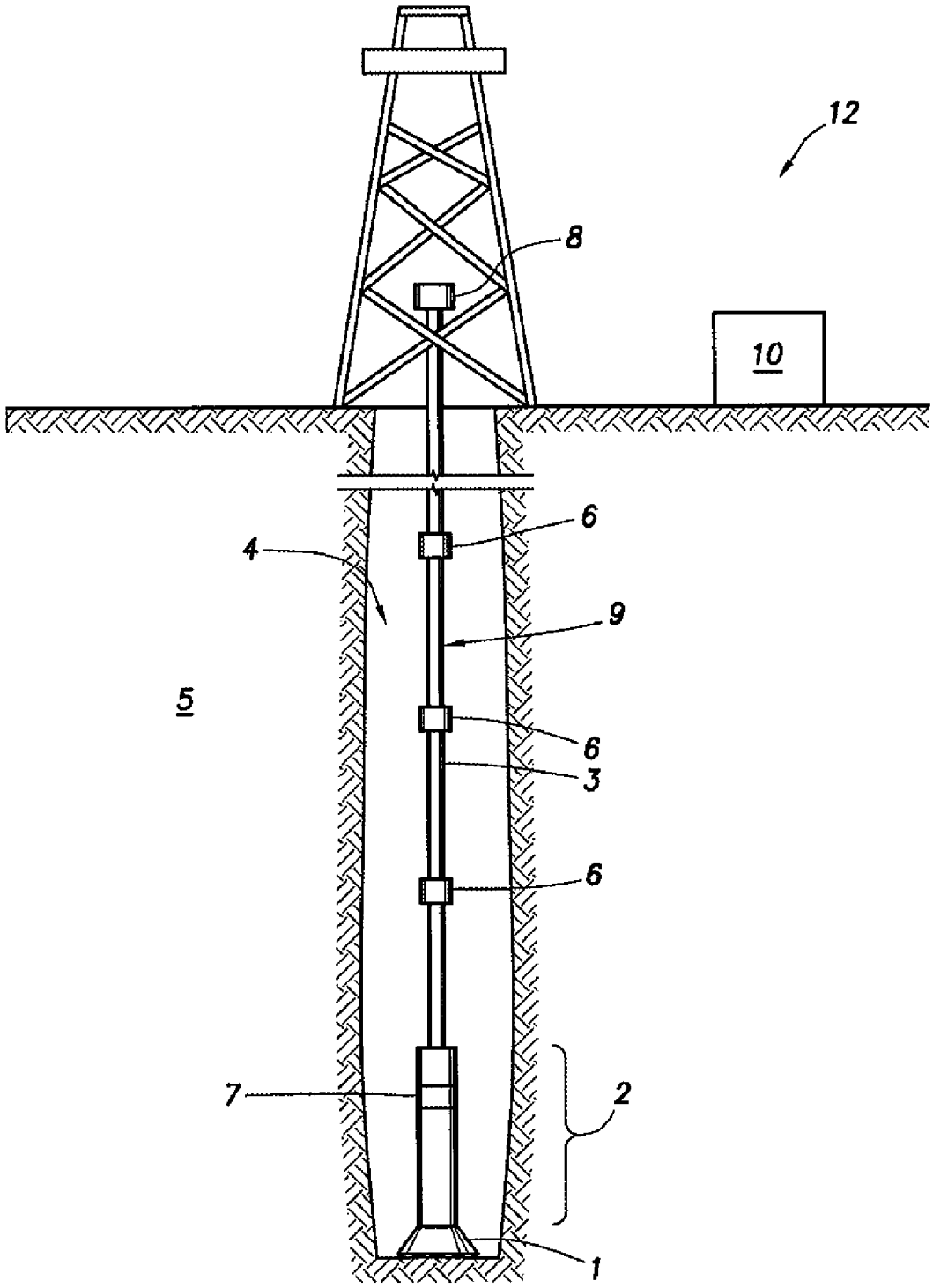
FIG. 1 shows a schematic of an example drill string.

FIG. 1 shows a schematic of an example drilling system 12 that includes a plurality of drill pipe segments 3 that form a drill string 9, with a bottom hole assembly ("BHA") 2, including a drill bit 1, at the lower end of the drill string 9. The BHA 2 is shown positioned within a borehole 4 in a rock formation 5. Alternatively, the drilling system 12 may be used in subsea drilling, as is known in the art. In one example, the drill pipe segments 3 are wired drill pipe. One example of a wired drill pipe is disclosed in U.S. Patent Application Publication No. 2006/0225926 filed by Madhavan, et al., and assigned to the assignee of the present application and incorporated herein by reference in its entirety.

At the top of the drill string 9 is a telemetry sub 8 that enables communication between the surface system 10 and the wired drill pipe. It is noted that other devices and other telemetry systems may be used. For example, a mud-pulse telemetry system may include pressure transducers at the surface that measure pressure fluctuations in the mud flow through the drill string. In another example, an electromagnetic telemetry system may include electrodes at the surface for measuring induced voltages. The bottom hole assembly may also include capabilities for measuring, processing and storing information, and communicating with the surface, as is known in the art.

Figure 2:
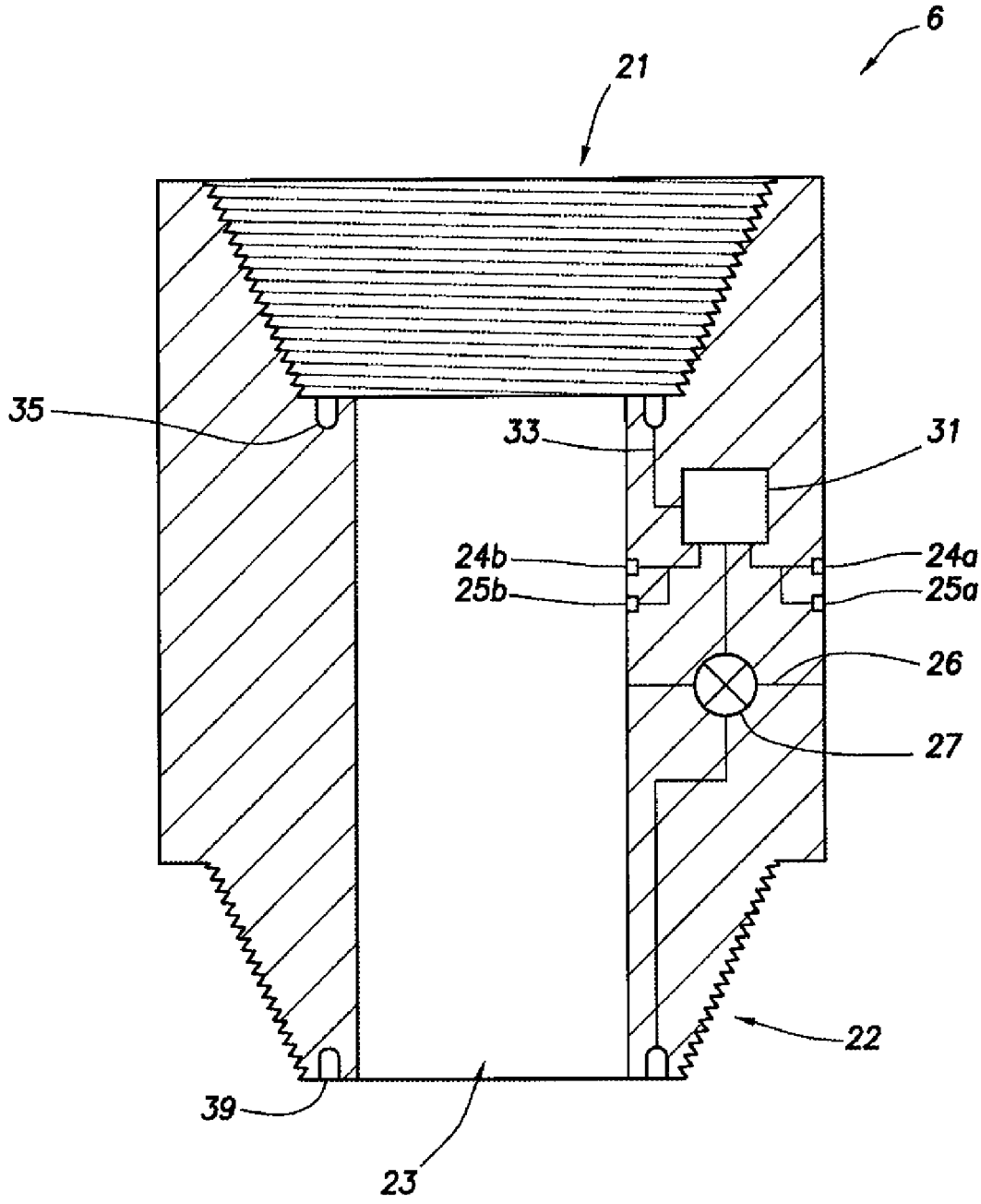
FIG. 2 shows a schematic of an example valve sub.

The drilling system 12 shown in FIG. 1 also includes at least one valve sub 6 that may include a valve to allow flow from the inside of the drill string 9 to the annulus, or from the annulus to the inside the drill string. In this disclosure, a valve may be described as being in fluid communication with the inside of the drill string and with the exterior of the drill string, called the "annulus." This is intended to indicate that the valve is disposed so that opening the valve will put the inside of the drill string in fluid communication with the annulus. However, a closed valve will cut off that fluid communication. The valve itself may remain in fluid communication with both, even though it is closed. A plurality of valve subs 6 may be arranged at intervals along the length of the drill string 9. The distance of the intervals may be adjusted in accordance with the well conditions. In the example shown in FIG. 1, the valve subs 6 are connected between segments of drill pipe 9. One example of a valve sub 6 is shown in FIG. 2. The valve sub 6 includes box end 21 and a pin end 22, similar to the connections on drill pipe. Thus, the valve sub 6 may be connected between pipe segments. It is also noted that valves could be disposed in other locations in a drill string. For example, a valve may be located or formed in a segment of drill pipe, rather than in a sub. The sub is shown as an example, and other examples are possible, as is known in the art.

The valve sub 6 in FIG. 2 includes a valve 27 that may be opened to provide a flow path between the central bore 23 in the center of the sub 6 and the annulus outside the sub 6. A flow path 26 may be provided between the central bore 23 and the annulus. The sub 6 may also include a telemetry link between its ends. For example, telemetry couplers, such as inductive couplers or direct connection couplers, may be provided in the pin and the box ends, such as such as the telemetry coupler 35 in the box end and telemetry coupler 39 in the pin end 22. A conductor 33 may be provided to connect the telemetry couplers 35, 39. The valve sub 6 may also include temperature sensors 24*a*, 24*b* and pressure sensors 25*a*, 25*b*. For example, one temperature sensor 24*a* and one pressure sensor 25*a* may be in fluid communication with the exterior of the sub 6, and sensors 24*b* and 25*b* may be in fluid communication with the interior of the sub 6. It is noted that sensors are not required, but are shown here as examples.

Thus, as described, a valve in a drill string may be controllable from the surface. In one example, a control signal may be transmitted by a wired drill pipe. In other examples, a signal may be transmitted by other means known in the art. For example, a control signal may be sent by making a preselected rotation of the drill string, where the rotation pattern is sensed near the valve. In another example, a control signal may be transmitted via mud pulse telemetry, where the pressure signals are sensed, for example, by pressure transducer 25*b*. In still other examples, a valve may be controlled by pumping a plug or magnetic material that may activate the valve.

In one example, the sub 6 may also include electronics and/or sensors, shown generally at 31. The electronics 31 may include a repeater and a battery, which may be used in wired drill pipe systems. The electronics 31 may include a processor and a memory for storing measurement data and other information. The sub 6 may include sensors for sensing various conditions about the sub 6, such as temperature and pressure. Other sensors may include various MWD/LWD sensors, such as resistivity sensors, direction and inclination sensors, seismic sensors, EM sensors, and other sensors known in the art.

In other examples, a valve 7 in FIG. 1 may be within the bottom hole assembly 2, thereby allowing control at a position near the bottom of the drill string. The valve 7 may be located in a flow path (not shown) between the inside of the BHA and the annulus.

In one example, the valves may comprise controllable valves that are arranged to open and close during drilling, by means of an actuator and a control system of a kind known to those skilled in the art. For example, an electric actuator may be controlled to open and close the valve whenever preprogrammed physical parameters are met. Such parameters may be well angle and/or well pressure. In another example, a valve may open or close upon receiving a command signal from the surface. In one example, such a signal may be from a surface computer (10 in FIG. 1) and may be transmitted via a wired drill pipe. In other examples, the valve may be controlled, for example, by the drill string being rotated at specific speeds in a predetermined sequence, or by acoustic or pressure pulses communicated from the surface.

In one example, the valve uses a bi-stable actuator which only draws power when changing state, such as that described in the UK Patent application No. GB 2408757. This allows each valve to be driven by a modest battery power supply. In another example, a valve that draws power when open may be used. Such a valve is often called a "fail closed" valve, since a power supply failure will close the valve.

The drilling system 12 offers the ability to selectively move or pass wellbore fluids from inside the drill pipe to the annulus, or vice versa, which provides multiple uses in all aspects of oilfield engineering. The use of valves in the drill string provides many opportunities to manipulate conditions in the wellbore. These conditions may involve two or more phases of fluids that may or may not be under pressure, and may be between distinct and separate pipes and annuli. The actuation of such valves can be performed while maintaining the full pressure containment integrity of the wellbore. The following description preferably utilizes the drilling system 12 described above.

For example, when the drilling system 12 is used in combination with External Casing Packers ("ECP's"), or other means of zonal isolation, specific treatments, pressure tests, or other similar practices can be carried out on selected and discrete portions of a wellbore without affecting or influencing any other zone.

The drilling system 12 may be used to maintain the density of drilling fluids during drilling, for "kick" control, for clearing of cuttings, for wellbore strengthening, for mud-cap drilling, for underbalanced or managed pressure drilling, and for starting up circulation in a hole.

Other downhole tools that are sensitive to pressure increases (e.g., systems employing mud-flow actuated pistons and related seals) may be protected by a "pressure-relief valve" or "port" that may be set and re-set remotely for protection of equipment that would otherwise be damaged by un-controlled pressure increases while drilling (e.g., blocked drill-bit nozzles or increases in flowrates or mud density).

Similarly, a valve below the pistons of a mud-flow pressure actuated tool may be remotely controlled. The aperture size of the valve may be used to control and/or fine-tune the pressure-drop generated below the pressure actuated pistons to both increase or decrease the force applied by the pistons; or to allow changes in flowrate or mud density to be accommodated without changing the force applied by the pistons.

Valves in the drill string can also be employed to aid downhole measurement. Varying downhole pressure through the means described above can be used with a logging tool investigating a zone with pressure dependent properties (e.g., acoustic or electrical), enabling log versus pressure data to be gathered.

In a similar manner, a pressure or flow transient may be created in the bottom hole region and the system response monitored. Valves in the drill string offer more precise control than pump or choke operations at the surface, providing advantages for creating a small influx, or briefly dropping the pressure to check that there is still an adequate margin above the pore pressure.

Valves in the drilling system may also be used in special situations. When pumping lost circulation material, or material to aid in wellbore strengthening, the zone to be affected will often not be near the bit. Instead of having to trip out the hole until the bit is just below the zone, the nearest valve or valves can be used, reducing the distance to trip and the time and risk involved. For instance, during mud-cap drilling, opening valves in the drilling system 12 can help maintain a density reversal in the annulus (heavier fluids above lighter fluids) by allowing fluid flowing initially down the inside of the drillstem to then flow down the annulus.

During underbalanced, or managed pressure drilling with gas pumped down the drill string, diverting some mud through controllable valves serves several purposes. Gas pumped down the drill string and then up the annulus significantly reduces bottomhole pressure at the very end of its path, high up in the annulus. Increasing the gas flow rate and opening valves close to the surface will quickly reduce bottomhole pressure; alternatively opening deeper valves and then closing the shallower valves will also reduce the bottomhole pressure.

When drilling underbalanced horizontal wells, the gas flowing through the horizontal section does not contribute to reducing the bottomhole pressure. The frictional pressure gradient of pumped and produced gas, combined with liquids, can make the maintenance of underbalanced conditions along the horizontal section problematic. Opening controllable valves above the horizontal section reduces the frictional pressure drop.

When starting up circulation in a hole, dead mud in the annulus may be progressively activated by opening up the valves near the surface first, and progressively shifting the fluid downhole.

The drilling system can be used to lift cuttings by sequentially opening and closing the valves from above the bottom of the widest section of the annulus to below the bottom of the widest section of the annulus. In operation, a first valve below the bottom of the widest section of the annulus is opened. As drilling progresses, this first valve will move down the well, until a second valve is below the bottom of the widest section of the annulus, at which time the second valve is instructed to open and the first valve below is instructed to shut.

At inclinations at or above 40 degrees, cuttings readily accumulate on the low side of the wellbore due to gravity, removing the cuttings from the fluid flow-path and restricting the fluid flow and increasing the frictional pressure losses, the wellbore friction (torque and drag), and the risk of pipe-sticking in the wellbore. Cuttings agitation is a concept employed in standard drilling operations and typically involves a mechanical device, similar to a standard stabilizer, to mechanically "scoop" cuttings and place them back into the flow stream for transportation up-hole. Using the controllable diversion valves along the drillpipe a hydraulic agitation system can be produced. By opening the valves to produce "jets" or "diffused jets" of drilling fluid, any cuttings lying on the bottom of the wellbore as the drillpipe is rotated are agitated. In another example, the valves may be opened only when on the low-side position of the pipe, activating the "jets" only when oriented towards the cuttings accumulation. Caution should be exercised so as not to interrupt the main annular flow above the drillpipe, risking washing-out or damaging the wellbore wall. In another example, the jetting action may be sequenced from the bottom to the top of the wellbore to create a "hydraulic conveyer" effect being imparted on the jetting/cleaning action.

At the end of a bit run, when cleaning out the hole and circulating cuttings to the surface, increasing the flow rate improves hole cleaning and reduces the time to bring cuttings to the surface. By opening one or more valves along the drill string, the flow rate is increased without increasing the pump pressure.

The methods described above for clearing cuttings can be activated, de-activated, and/or sequenced remotely, or automatically based on other well-bore measurements, such as, but not limited to, pressure sensors or inclination sensors.

When pulling out of a hole, if a buildup of cuttings is encountered, a fluid exit with upward pointing jets could be set at the top of the collars. The jet fluidizes the cuttings bed and reduces the likelihood of getting stuck. If ports were added to exit at the surface, by activating the fluid flow when whirl is detected, a form or hydrodynamic lubrication is generated. This modifies the local friction coefficient and could be enough to change the whirl characteristics.

With a motor running and fluid flowing through the drill string, if drilling is suspended but fluid flow continues, the components below the motor continue to rotate unconstrained. This rotation may result in a cavity being created by the impact on the borehole wall resulting in damage to the drillstem components. Controllable valves above the motor allows the majority of the flow to by-pass the motor and reduce or eliminate the rotation below the motor (if the residual flow is insufficient to generate motor rotation).

A conservative approach identifies casing points and the maximum depth below that casing point which can be drilled to for known or unknown formation pressures. The design and/or safety factors employed reflect the knowledge available for the well and the level of conservatism applied. The variables used in the casing design rely on the strength of the formation below the last casing shoe, and the depth at which the formation pore pressure becomes too high to drill ahead without breaking down the weakest formation with the drilling fluid density required to balance these formation pressures. Typically, it is assumed, unless there is specific knowledge available, that the weakest formations are those directly below the casing shoe (bottom of the casing).

The maximum depth that can be drilled, below the last casing shoe is also evaluated in terms of receiving an unplanned and/or uncontrolled influx of formation fluid and/or gas which is commonly known as "taking a kick". Estimates are calculated for, but are not limited to, the maximum pore-pressure expected, the volume of the influx that can be received and the Maximum Allowable Annular Surface Pressure ("MAASP"). Once these criteria are determined, the potential loads and pressures exerted while experiencing and circulating a "kick" are calculated and evaluated against the equipment limitations of the drilling rig and the formation strength/casing design. This process identifies the "Kick Tolerance." The rig blow-out preventer (BOP) and ancillary well control equipment is purposefully built to control casing pressures in a wellbore and are designed to withstand the anticipated maximum surface pressures for the types of well being drilled.

When a kick is detected, circulation is halted and the wellbore is shut in. The "Constant Bottom Hole Pressure" method, whereby bottom hole pressure is maintained substantially at or above formation pore pressure, may be employed to kill the well. There are two common variations of the Constant Bottom Hole Pressure method, the "Driller's Method" and the "Engineer's Method." In the Driller's method, the original mud weight is used to circulate the contaminating formation fluid from the wellbore. Thereafter, kill weight mud is circulated through the drill string and into the wellbore. In the Engineer's method, the kill weight mud is calculated and prepared and then circulated through the drill string and into the wellbore to remove the contaminating formation fluid from the wellbore and to kill the well. The Engineer's method may be preferable to the Driller's method as it often, but not always, maintains the lowest casing pressure during circulation of the kick from the wellbore, thereby minimizing the risk of damaging the casing or fracturing the formation and creating an underground blowout.

After an influx is detected, and during its circulation to surface, the casing pressure is regulated to prevent further influx. By choking back on the casing pressure, back-pressure is added to the annulus. The backpressure is typically below the equipment rating, however, when combined with the hydrostatic pressure exerted by the drilling fluid, the fracture pressure of the formation below the shoe may be exceeded, resulting in an "underground blowout". This casing pressure at the surface is described as the MAASP.

MAASP is often mis-understood as the name implies that surface pressure should not be allowed to exceed some preset value. However, sufficient surface pressure must be applied to stop further influx of formation fluids/gasses into the wellbore even if it exceeds the MAASP despite the risk of underground blow-out. Once the influx passes the shoe, the pressure at the shoe will be reduced along with the risk of formation breakdown. The maximum pressure at the surface needs to remain below the equipment ratings to maintain control of the wellbore and preserve both the safety of personnel and the installation.

If a fluid or gas influx is detected early in the well, by opening one or more valves in the drill string below the influx and displacing heavier kill mud into the annulus below the influx, the hydrostatic pressure in the annulus may be increased more quickly than by just pumping down the drillpipe and waiting for the kill mud to enter the annulus through the bit. The influx may reach the shoe before the kill mud reaches the annulus thus resulting in the highest pressure at the shoe. This is especially true in high angle or horizontal holes where fluid density in the lower horizontal annulus has little or no effect on bottom hole pressure as it has no vertical height. Furthermore, in some circumstances such as shallow gas situations where no BOP is present, bypassing the bit may allow higher pump rates to be used increasing the effectiveness of the kill mud; or to effect a "dynamic kill" by the associated increased friction pressure losses adding greater back-pressure. Kill control is particularly enabled by the use of distributed measurements, such as temperature and pressure, which allow the location, volume, and composition (type—derived from density), of different fluids and/or gases to be estimated in the annulus.

The use of distributed measurements, such as, but not limited to, temperature and pressure, will allow the early detection of a formation fluid and/or gas influx. The location of each sensor may be calculated via either a surface, or a downhole, system/process that monitors the drill string movement relative to the wellbore survey calculation. In one example, each sensor has a unique identifier so that its position in the string is known and that is added to the data being recorded by that sensor. Therefore the actual sensor position in the wellbore, at the time the data is recorded, is calculated by the surface system by referencing the wellbore survey calculation. Alternatively, the positional information may be sent to the sensor and this is included in the data output and sent back up-hole to the surface pressure monitoring/calculating system.

When the position of each sensor is known relative to the wellbore, it is then possible to calculate pressure changes over vertical height to derive density, and over measured depth to derive volumes; both measurements are critical to plan and monitor well control operations.

An alternative and/or supporting method to identify an influx of fluid/gas of a density different to that of the circulating system is by the use of azimuthal formation density measuring devices (standard state of the art equipment that are capable of directly measuring the density of the wellbore annular fluid, under specific circumstances/conditions, that would indicate very clearly an influx to the annulus. Through direct (wired), or other telemetry, such as, but not limited to, mud-pulse, the presence/occurrence of an influx will be transmitted to surface. Upon determining the kick criteria, the appropriate operation of the valves (6 and/or 7) is determined (304) and the valves are operated as necessary to alleviate the kick (305).

Additionally, a drill string valve may be used to better seal a lost circulation zone. Lost circulation material may be delivered to a specific place in the wellbore, for example, in a lost circulation zone. In this manner, the lost circulation zone may be exposed to the lost circulation material, without such material moving through the BHA and the drill bit.

In some examples, lost circulation zones may be detected and located through the use of distributed pressure and temperature measurements. In general, the mud will have a higher temperature than the surrounding formation near the surface, and the mud will be cooler than the surrounding formation near the bottom of the well. The temperature differential between the mud and the formation will create a predictable temperature profile in the mud column. If for example, the temperature is observed to jump or dip from the expected value, this information can be used in determining the location of a lost circulation zone.

For example, when there exists a lost circulation zone, where mud is flowing into the formation, the mud flow rate just above the lost circulation zone, in the annulus, will be lower than it would be if there were no lost circulation. Thus, the mud will be resident in a higher temperature environment for a longer period of time, and the temperature jump in the vicinity of the lost circulation zone can be used to identify the location of the lost circulation zone.

Figure 6:
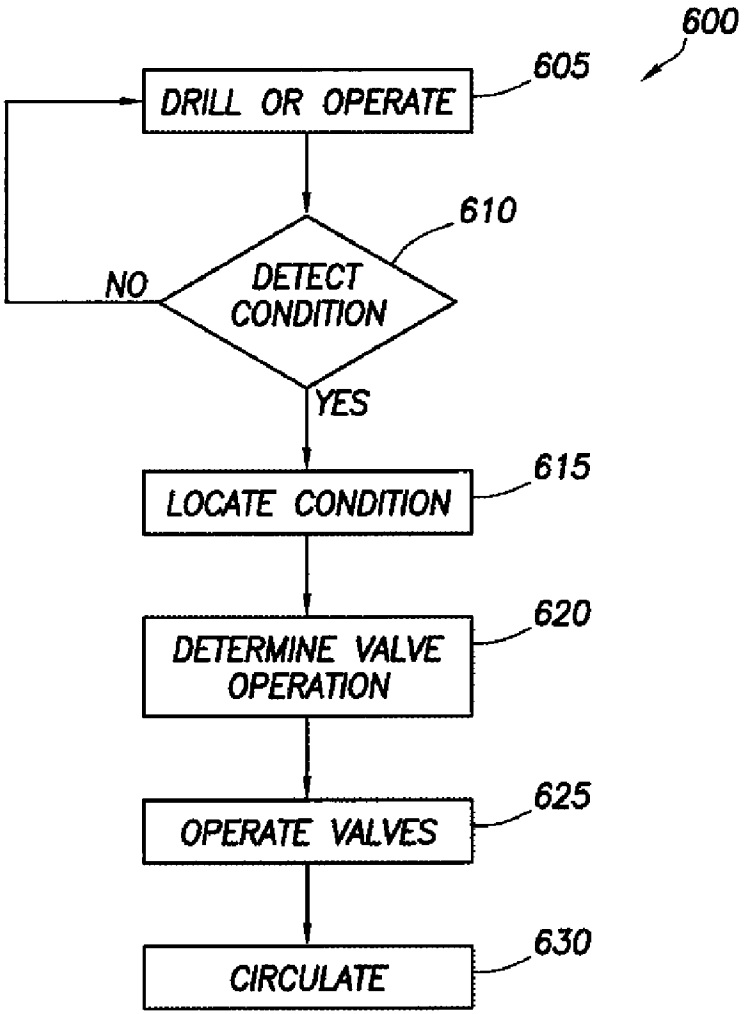
FIG. 6 is a flowchart of an example method for well operations.

FIG. 6 shows an example of a simplified method 600 for using one or more drill-string valves in a drilling operation. The method 600 includes drilling or operating at step 605. This step is meant to indicate a normal drilling operation, such as drilling ahead or a suspension of the drilling process for another typical operation, such as adding drill pipe or any other operation. This step is not intended to be limiting, but merely to show that certain methods may be used in connection with normal drilling operations.

Next the method may include determining if there has been an anomalous drilling condition, at step 610. Examples of anomalous drilling conditions may include an influx, a lost circulation condition, the presence of a cuttings bed, or a complete blockage of the annular flow-path otherwise known as a "pack-off." Detection of an anomalous drilling condition may be done by distributed temperature or pressure measurements, by measuring mud flow rates, or other means known in the art. The method may next include determining the location of the condition or anomaly, at step 615. In one example, this may be done based on pressure or temperature measurements. For example, distributed temperature and pressure measurements may indicate the location of an influx or of a lost circulation zone. In another example, a density measurement may identify the location of a cuttings bed.

The method may next include determining the operation of drill string valves, at step 620. This may include opening a valve in a particular position with respect to the condition, such as opening a valve below or adjacent to an influx or opening a valve below a lost circulation zone. It is noted that this step may be omitted where the valve operation is apparent from the condition. In such example, the proper operation of the valves may be apparent or necessary based on the condition. In such a case, there may be no specific step to determine a valve operation.

The method may next include operating one or more drill string valves, at step 625, and circulating mud at step 630. The mud may be drilling mud, kill mud, or other types of mud, such as mud that include lost circulation material ("LCM"). In addition, those having ordinary skill in the are will realize that the order of these steps may be altered. For example, mud may be circulated before and/or after a valve is operated.

The following examples show more specific methods for operating one or more drill string valves in response to a drilling condition or anomaly.

Figure 3A:
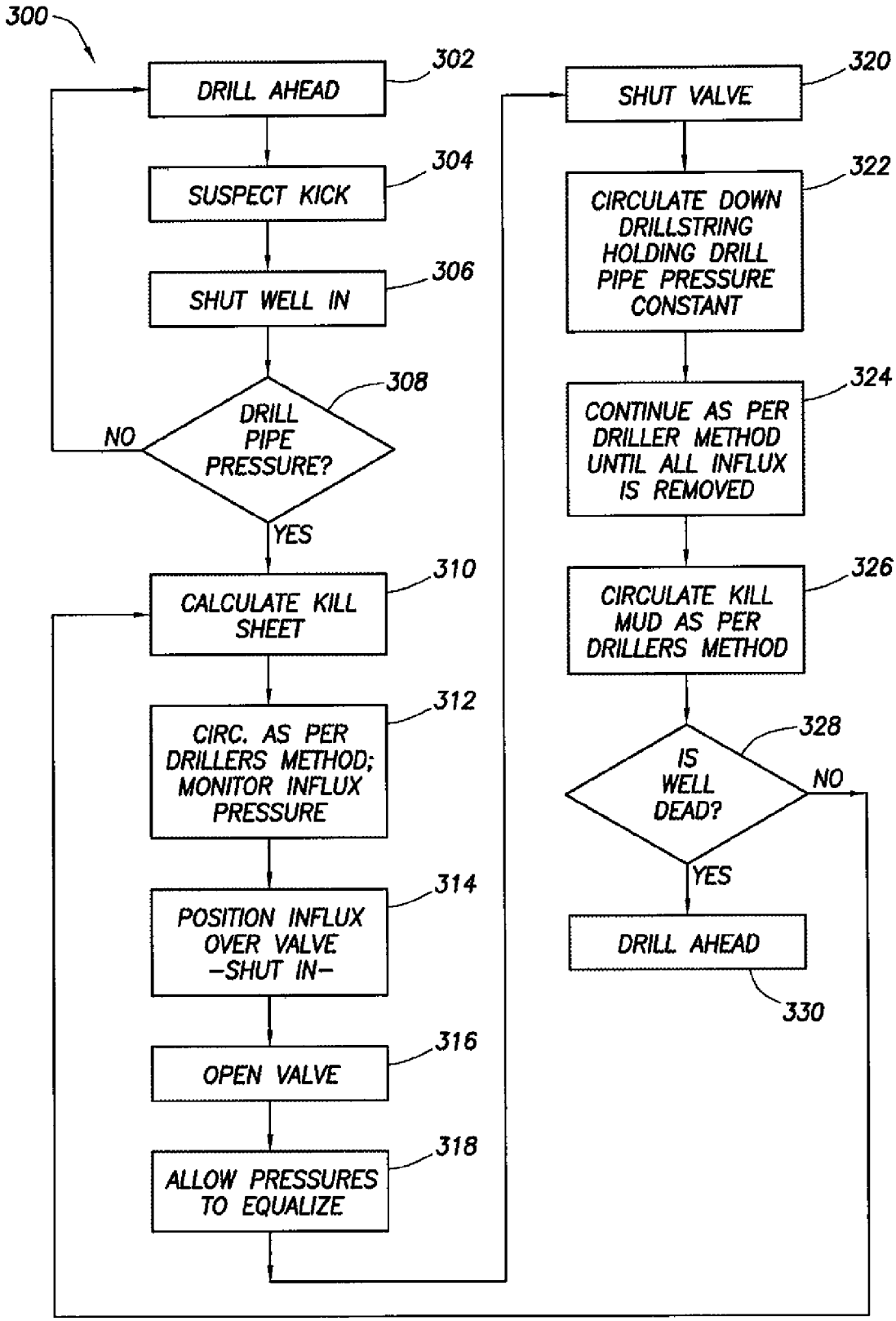
FIG. 3A shows a flow chart for an example method for controlling a well.

FIG. 3A shows an example method 300 for controlling a well influx. It is noted that the description of the example method include steps that may not be necessary when controlling an influx. It will be apparent to a person having ordinary skill in the art, from the description, which steps may be omitted.

Steps 302-308 in FIG. 3A show an example method for determining if there has been an influx of formation fluids into the borehole. This is provided as an example; any method or steps for determining that an influx has occurred may be used. As an example, drilling ahead is shown at step 302. This may represent normal drilling operations, and it may also represent any special drilling operations, where the drill bit is advancing through a formation. Next, the method may include suspecting that an influx has occurred, step 304. This may be done using any way that is known in the art, such as monitoring the annular pressure, monitoring mud flow return rates and/or mud-pit volumes at the surface, changes in drilling speed, or any other method. Next, the method may include shutting in the well, step 306. This may include activating a blow-out preventer ("BOP") or any other well control valves that will shut in the well.

The method may next include measuring the drill pipe pressure to determine if there has been an influx, step 308. Under a normal drilling condition the hydrostatic pressure generated by the drilling fluid is directly proportional to its density and the vertical height of the fluid column. The density of the fluid is engineered to provide a hydrostatic pressure that exceeds, by a predetermined margin, the expected formation pressures while drilling so that well-control is maintained and no wellbore fluids (liquid or gas) can enter the wellbore as an influx. The drilling fluid system, and the pressure generated by it, is referred to as "primary" well control. When an uncontrolled "influx" occurs, commonly referred to as a "kick," the primary well control may have been lost and the hydrostatic pressure generated by the fluid density was inadequate to control the formation pressure.

The drillpipe inside the wellbore forms one side of a "U-tube," while the annulus forms the other side of the "U-tube"; under normal drilling conditions where the same density of fluid is in the annulus and drill pipe the "U-tube" is balanced and closing, or "shutting-in," a balanced well will not result in any pressure at surface on either the casing or drill pipe. When a "kick" occurs and the well is shut-in, the pressures both on the drill pipe and annular (casing pressure) sides of the U-tube will reflect the kick condition in the wellbore. The only known variables in this situation are the vertical height and density of the column of fluid inside the drill pipe as the annulus has received an influx of fluid and/or gas of an unknown density and volume. The shut-in drill pipe pressure (SIDPP) recorded at surface is a direct measure of the Bottom-hole pressure (BHP) above the hydrostatic pressure generated by the known fluid density and column vertical height—that is the SIDPP plus the calculated hydrostatic pressure is equal to the bottom hole pressure (SIDPP+Fluid Hydrostatic=BHP). The Shut-in Casing Pressure (SICP) will be different from the SIDPP as it has fluids/gases of differing densities and volume distributed throughout the annulus. Once the BHP has been established using the SIDPP, it is then possible to calculate the likely influx density (and therefore type), and the volume of the influx can be inferred by the volume of fluid displaced from the wellbore before the well was "shut-in."

Figure 3B:
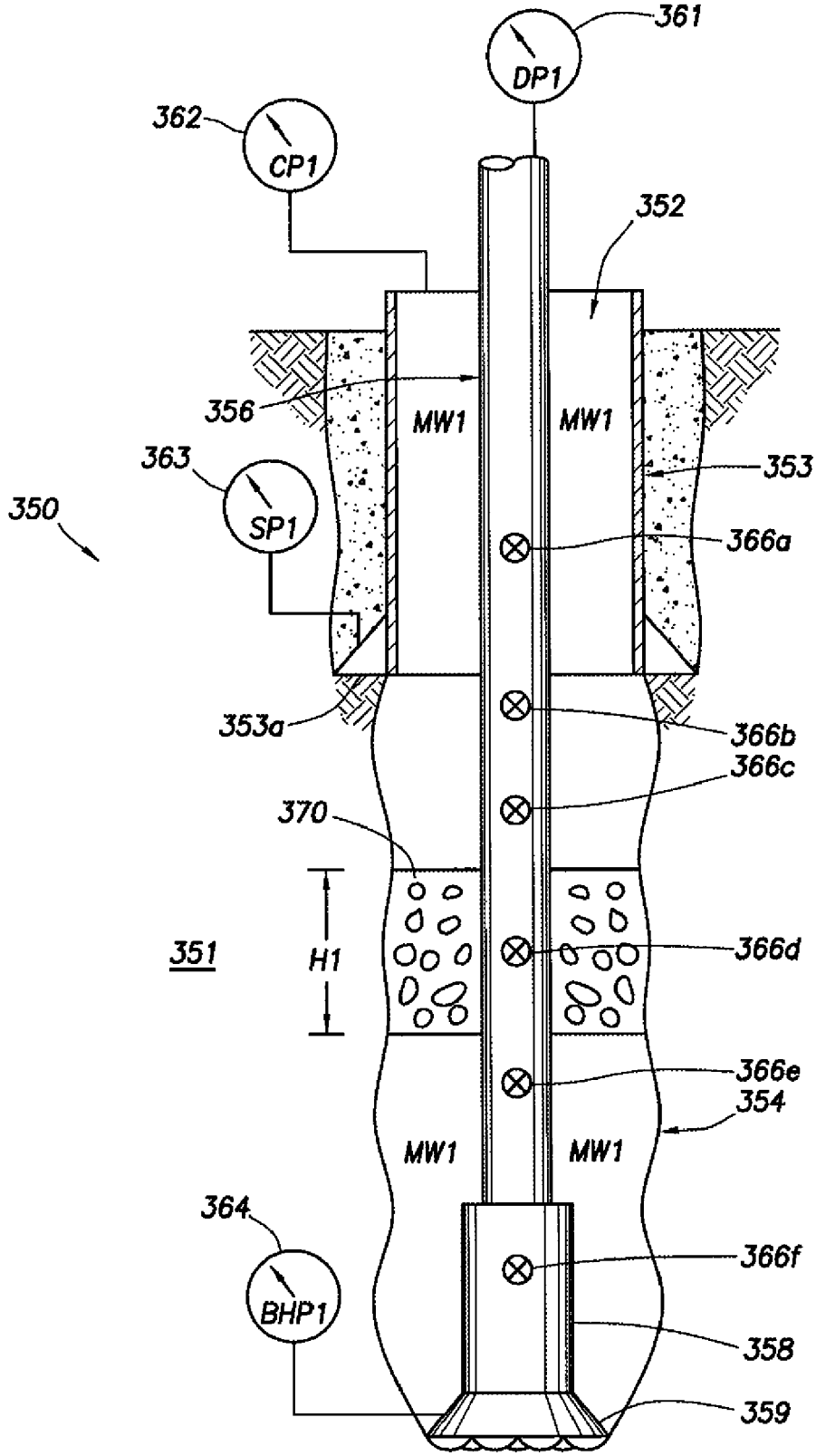
FIG. 3B shows a schematic an example wellbore with an influx.

FIG. 3B shows a schematic of a drilling operation 350 where an influx 370 has occurred. FIG. 3B shows a wellbore 352 that is being drilled by a drill string 356 having a drill bit 359 at its lower end. The drill string includes a bottom hole assembly ("BHA") 358 and is shown with several drill string valves 366*a-f*. In one example, the drill string 356 is made up of segments of wired drill pipe, for transmitting control and data signals along the drill string.

As shown in FIG. 3B, the drill string valves 366*a-f* may be closed for typical drilling operations. The borehole 352 includes a cased section 353, with a casing shoe 353*a*, and an uncased section 354. The partially cased well shown in FIG. 3B is typical for drilling, but it is not intended to be limiting.

FIG. 3B shows several pressure measurements, with representations of pressure sensors. These representations are used to show in general where such pressure measurements may be made, but are not specifically limited to a location or any type of sensor. In fact, some pressures may be determined by calculation, and not by a direct measurement. The pressures include a drill pipe sensor 361, a casing pressure 362, a shoe pressure 363, and a bottom-hole pressure 364. Typically, the shoe pressure 363 and the bottom-hole pressure 364 are calculated, although they may be measured with a sensor when a pressure sensor is provided at these locations.

FIG. 3B also shows an influx 370 in the borehole 352. The influx 370 represents formation fluids, which may include liquids and gasses that have flowed into the borehole 352 from the formation 351. As shown in FIG. 3B, the influx 370 occupies a vertical height represented by H1.

Thus, based on the method shown in FIG. 3A, on suspicion that an influx may be present in the wellbore, the well may be shut-in and the presence of an influx may be confirmed by the measurement of the stabilized drill pipe pressure and casing pressure (step 308 in FIG. 3A).

Returning to FIG. 3A, the method may next include calculating a kill sheet, at step 310. A kill sheet aids in understanding the current wellbore condition and in determining the kill mud weight and pumping speeds to be used when killing a well. This may be done using techniques known in the art. Further, this step may be accomplished through automatic methods, such as a computer programmed to acquire data and calculate a kill sheet. Next, the method may include circulating kill mud into the well in accordance with the "Driller's Method" for killing a well, at step 312.

The Driller's Method is a method used to kill a well that is known in the art. In general, the Driller's method involves two full circulations to kill the well. During the first circulation, the drill pipe pressure is maintained at a constant value until the influx is circulated from the wellbore using original mud weight. During the second circulation, kill mud is pumped to the bit while following the drill pipe pressure step-down schedule established in the kill sheet. If all the kick fluid was successfully circulated from the well in the first circulation, the casing pressure should remain constant until the kill mud reaches the bit. When the kill mud enters the annulus, the drill pipe circulating pressure is maintained constant until the kill mud reaches surface.

Returning to the method, it may next include positioning the influx over a drill string valve (e.g., valve 366*d* in FIG. 3B) and shutting in the well, at step 314. Conventional circulation down the drill pipe is recommended in order to keep the procedure simple and be able to maintain well control based on the familiar Drillers Method. Circulation can be stopped (see step 312) when the influx position is determined, either by sensor readings on the drill string, or by theoretical calculations based on the volume pumped, to be positioned over a drill string valve (e.g., 366*d* in FIG. 3B). The well must be circulated through the choke as per the Drillers Method in order to maintain control over the drillpipe pressure (361 in FIG. 3B) and subsequently the Bottom-Hole Pressure (BHP) (364 in FIG. 3B).

Figure 3C:
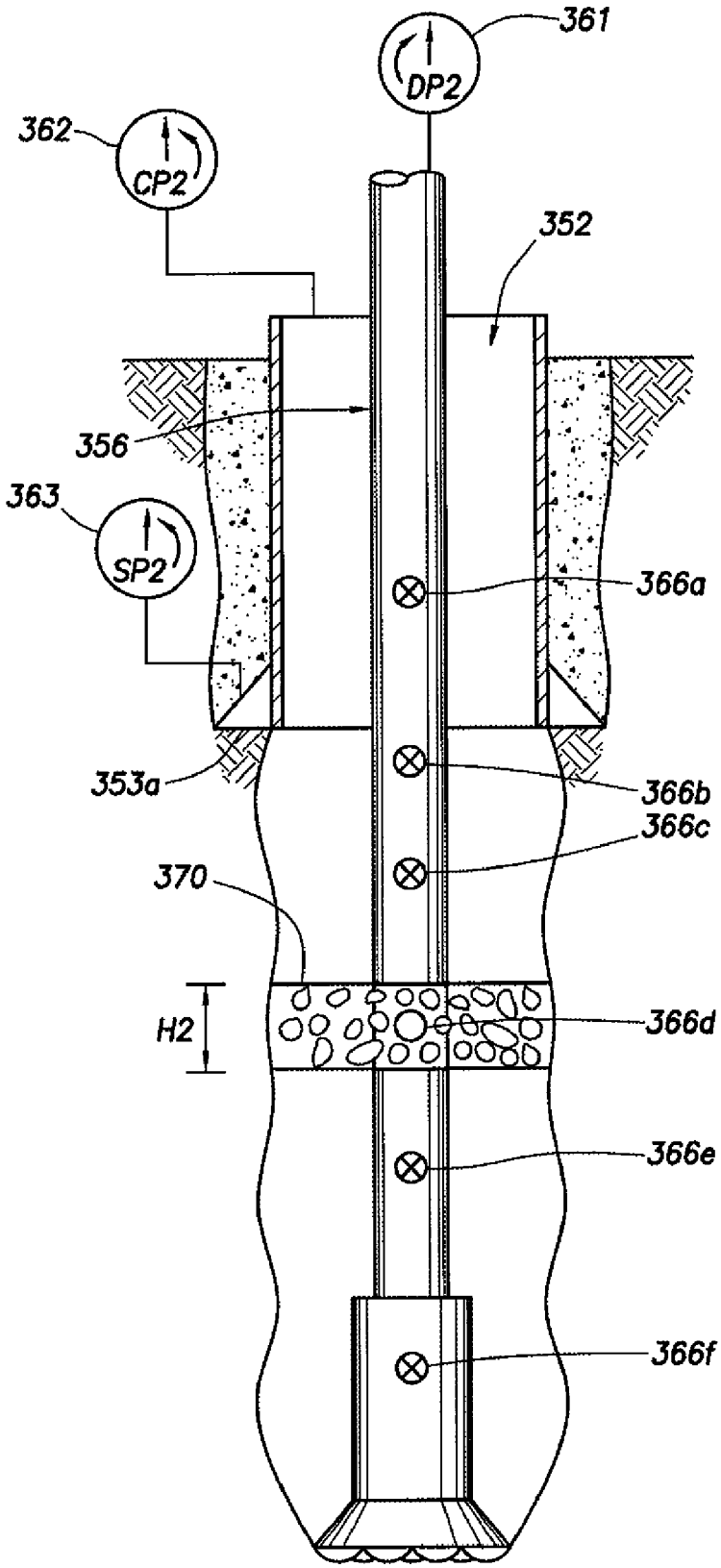
FIG. 3C shows a schematic of an example wellbore with an influx.

FIG. 3C shows an influx 370 that has been circulated so that it is positioned over a drill string valve 366*d*. Once the circulation is stopped with the influx 370 positioned over the valve 366*d*, the drill string valve 366*d* may be opened, as shown in step 316 in FIG. 3A. The drill string and annular pressures may be allowed to stabilize, at step 318. As the pressures stabilize, at least a portion of the influx 370 will enter the drill string 356 through the open drill string valve 366*d*. As a portion of the influx 370 enters the drill string 356, the vertical height of the influx 370 in the annulus is reduced from H1 (shown in FIG. 3B) to H2, as shown in FIG. 3C. In addition, when a portion of the influx 370 enters the drill string 356, the drill string pressure 361 will increase. Correspondingly, the shoe pressure 363 and the casing pressure 362 will decrease. The method shown in FIG. 3A may then include shutting the drill string valve 366*d*, at step 320 to isolate the portion of the influx (370 in FIG. 3C) in the drill string (356 in FIG. 3C) from the portion in the annulus.

Figure 3D:
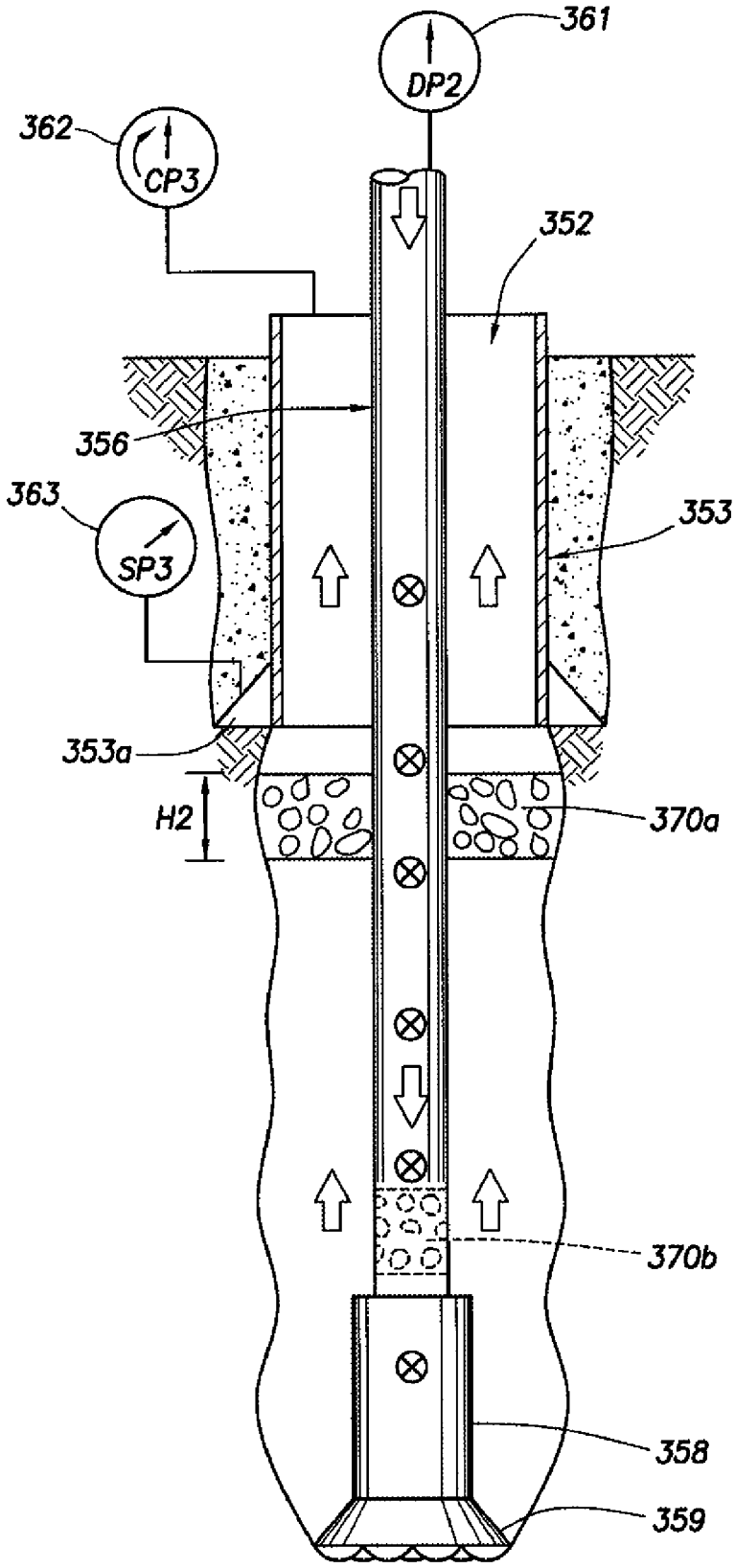
FIG. 3D shows a schematic of an example wellbore with an influx.

The method shown in FIG. 3A may next include circulating mud down the drill string, while holding the drill string pressure constant, at step 322. In one example, this is accomplished by manipulating the choke on the annulus. As shown in FIG. 3D, the circulation of mud through the drill string 356 (flow direction shown in arrows) causes the portion of the influx in the drill string 370*b* to be circulated down the drill string 356, and the portion of the influx in the annulus 370*a* may be circulated upwardly in the annulus. The portion of the influx in the drill string 370*b* may be circulated downwardly so that it eventually exits through the drill bit 359 and is then circulated to the surface through the annulus. In one particular example, it may be desirable to ensure that the portion of the influx in the annulus 370*a* is circulated upwardly passed the casing shoe 353*a* before the portion of the influx in the drill string 370*b* exits the drill string 356 through the bit 359. This may ensure that the shoe pressure 363 does not exceed a predetermined maximum value (MAASP).

Returning to FIG. 3A, the method may include continuing to circulate, in accordance with the Driller's Method, until all of the influx (both the portion in the annulus 370*a* and the portion in the drill string 370*b*, in FIG. 3D) has been removed from the well, at step 324. Once the influx is removed, the method may include circulating a kill mud, in accordance with the Driller's Method, to kill the well, at step 326.

Next, the method may include evaluating whether the well is dead, at step 328. This may include shutting in the well and measuring the drill pipe pressure, as was described with respect to steps 306 and 308, above. If the well had been killed, the method may include drilling ahead, at step 330. If it is determined that the well has not been killed, the decision in step 328 may include returning to step 310 and repeating the steps to kill the well. The process between steps 310 and 328 may be repeated until the well has been successfully killed.

Figure 4A:
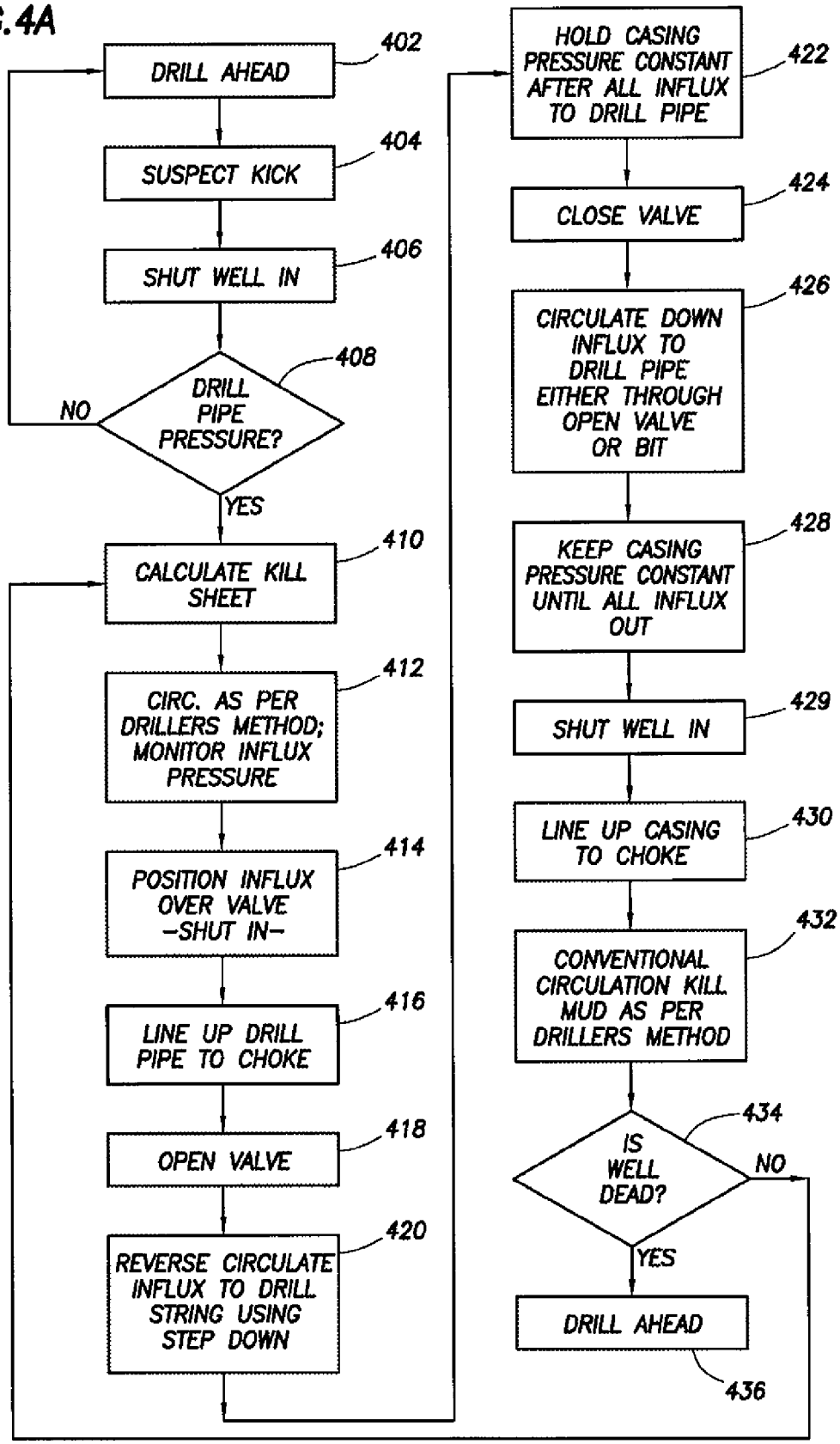
FIG. 4A shows a flow chart for an example method for controlling a well.

FIG. 4A shows another example method 400 for controlling a well influx. The first four steps shown in FIG. 4A, steps 402, 404, 406, and 408, are similar to steps 302, 304, 306, and 308, shown in FIG. 3A, and they may be accomplished in the same manner described above. In summary, the method includes drilling ahead (step 402) until a influx, or "kick," is suspected (step 404). The well may be shut in (step 406) and the drill pipe pressure may be measured to determine if an influx has entered the well (step 408).

Figure 4B:
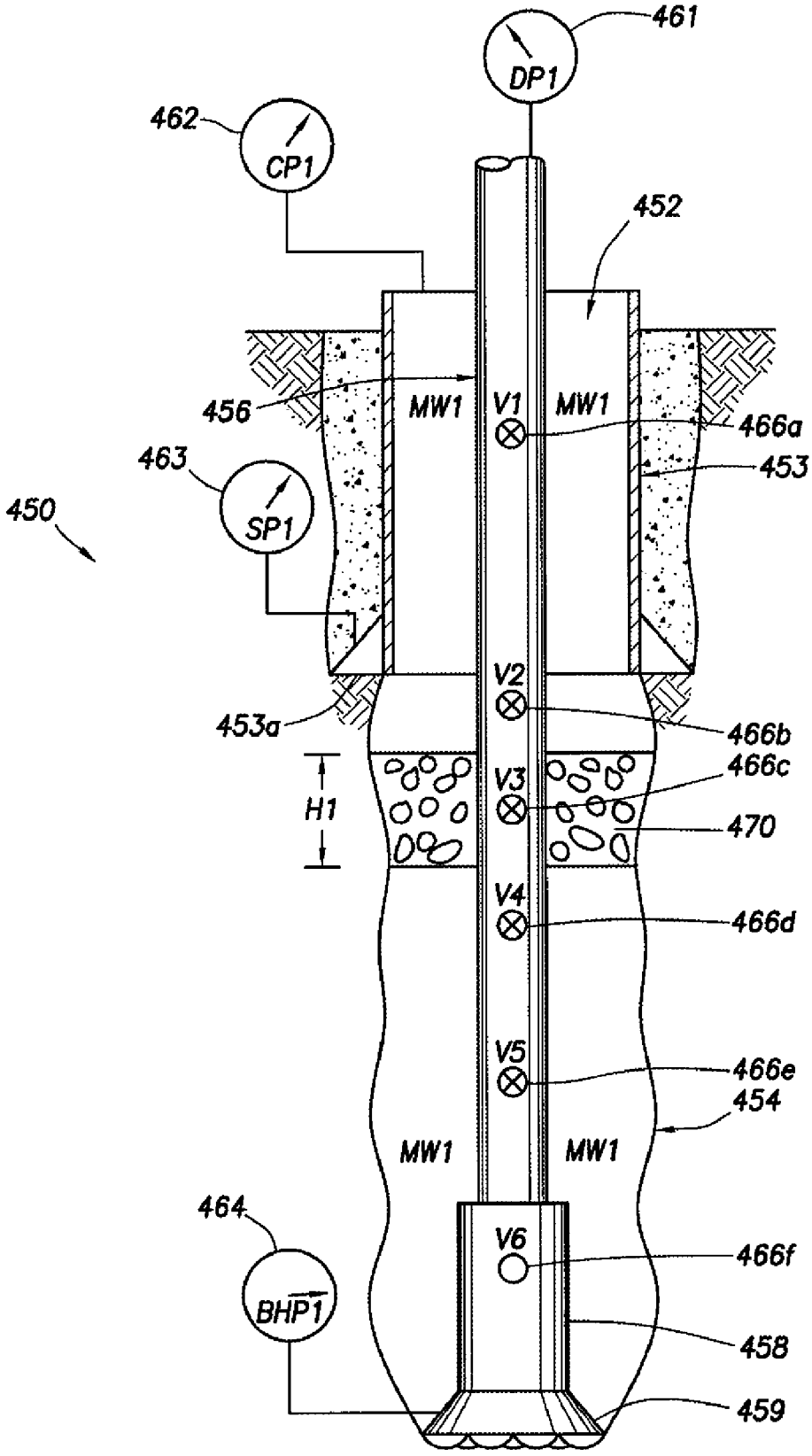
FIG. 4B shows a schematic an example wellbore with an influx.

FIG. 4B shows a schematic of a drilling operation 450 where an influx 470 has occurred. FIG. 4B shows a wellbore 452 that is being drilled by a drill string 456 having a drill bit 459 at its lower end. The drill string includes a BHA 458 and is shown with several drill string valves 466*a-f*. In one example, the drill string 456 is made up of segments of wired drill pipe, as described above.

As shown in FIG. 4B, the drill string valves 466*a-f* may be closed for typical drilling operations. The borehole 452 includes a cased section 453, with a casing shoe 453*a*, and an uncased section 454. FIG. 4B shows several pressure measurements, with representations of pressure sensors. As with FIGS. 3B-D, these representations are used to show in general where such pressure measurements may be made, but are not specifically limited to a location or any type of sensor.

FIG. 4B also shows an influx 470 in the borehole 452. The influx 452 represents formation fluids, which may include liquids and gasses that had flowed into the borehole 452 from the formation 451. As shown in FIG. 4B, the influx 470 occupies a vertical height represented by H1.

Returning to FIG. 4A, the method may include calculating a kill sheet, at step 410, and circulating drilling mud into the well in accordance with the Driller's Method for killing a well, at step 412. Conventional circulation down the drill pipe may be desirable to keep the procedure simple and to be able to maintain well control based on the Drillers Method known in the art. The circulation may be used to circulate the influx until it is positioned above a selected drill string valve (e.g., one of valves 466*a-f* in FIG. 4B) and the well shut in, at step 414. For example, the influx 470 in FIG. 4B is shown positioned above valve 466*d*. It is noted that the influx 470 is also shown positioned adjacent valve 466*c*, but it is not above valve 466*c*. This drawing, however, is not drawn to scale, and the valve spacing used in practice may be much longer than the height H1 of an influx 470, so that an influx positioned over a drill string valve would not also be adjacent to another valve.

Next, a method for controlling an influx, such as the example method in FIG. 4A, may include lining up the drill pipe to a choke, at step 416, to facilitate control of the casing pressure while reverse circulating in step 420 in FIG. 4A.

Figure 4C:
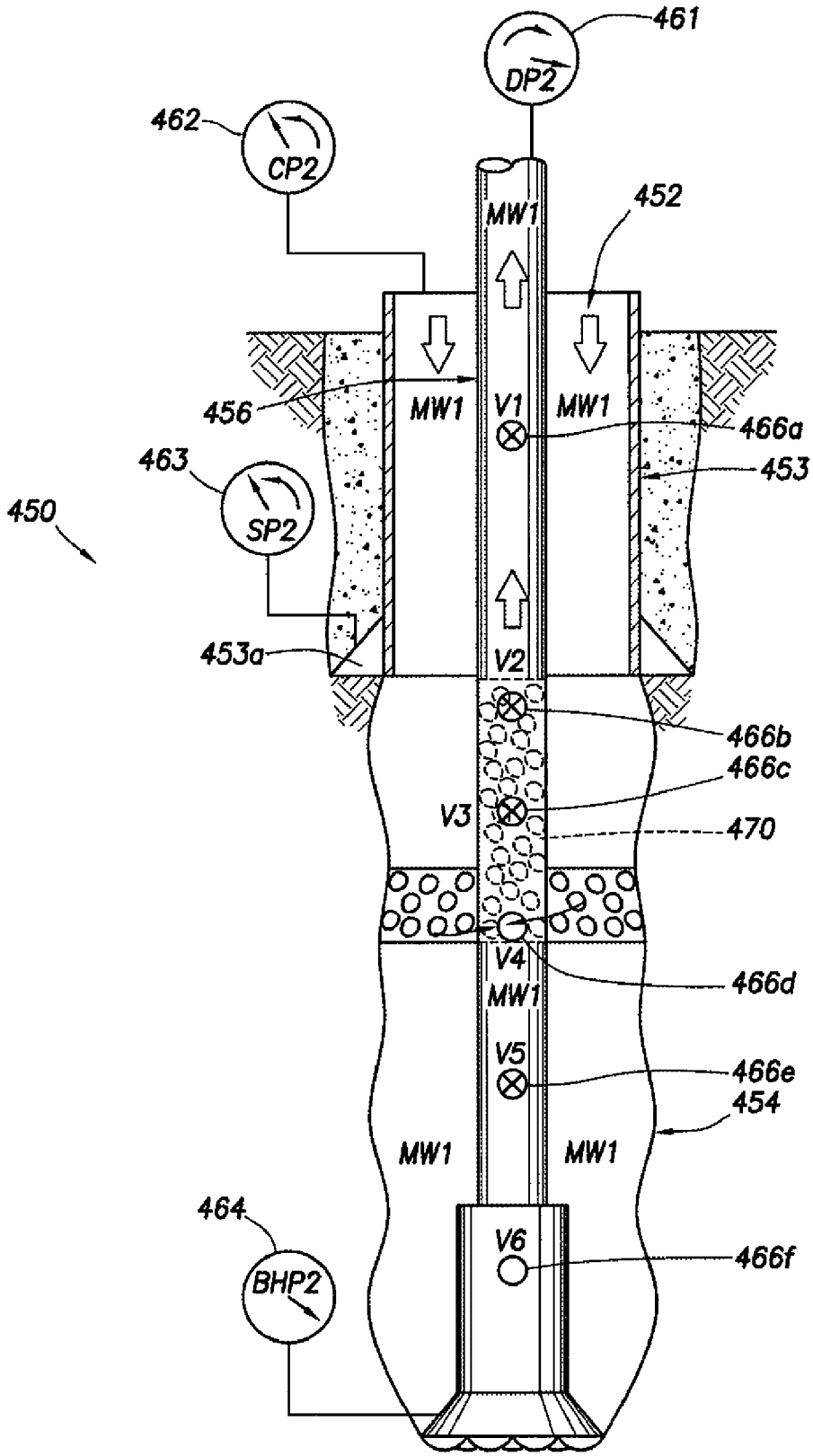
FIG. 4C shows a schematic of an example wellbore with an influx.

Next, the method will include opening the valve above which the influx has been positioned, at step 418. As shown in FIG. 4C, the drill string valve 466*d* positioned below the influx 470 may be opened. Once opened, the fluid in the well may be reverse circulated (i.e., down through the annulus) so that the influx 470 flows through the valve 466*d* from the annulus into the drill string 456. This is shown at step 420 in FIG. 4A. FIG. 4C shows arrows indicating flow direction. As can be seen, mud is circulated downwardly through the annulus, forcing the influx 470 to enter the drill string 456 through valve 466*c*. The flow then continues upwardly through the drill string 456, circulating the influx 470 upwardly along with the flow.

As shown in FIG. 4C, circulating the influx into the drill string 456 will affect the pressures in the system. The drill string pressure 461 will increase due to the influx 470 flowing into the drill string 456. Conversely, the casing pressure 462 and the shoe pressure 463 will decrease while reverse circulating the influx down the annulus and into the drill string through open valve 466*d*. A step-down table may be required to account for the loss of influx to the drill string. Drilling mud may be pumped down the annulus to replace the influx as it is passed to the drill string, and the choke on the drill string will control the return flow from the drill pipe to regulate the circulating (casing) pressure on the annulus side.

Figure 4D:
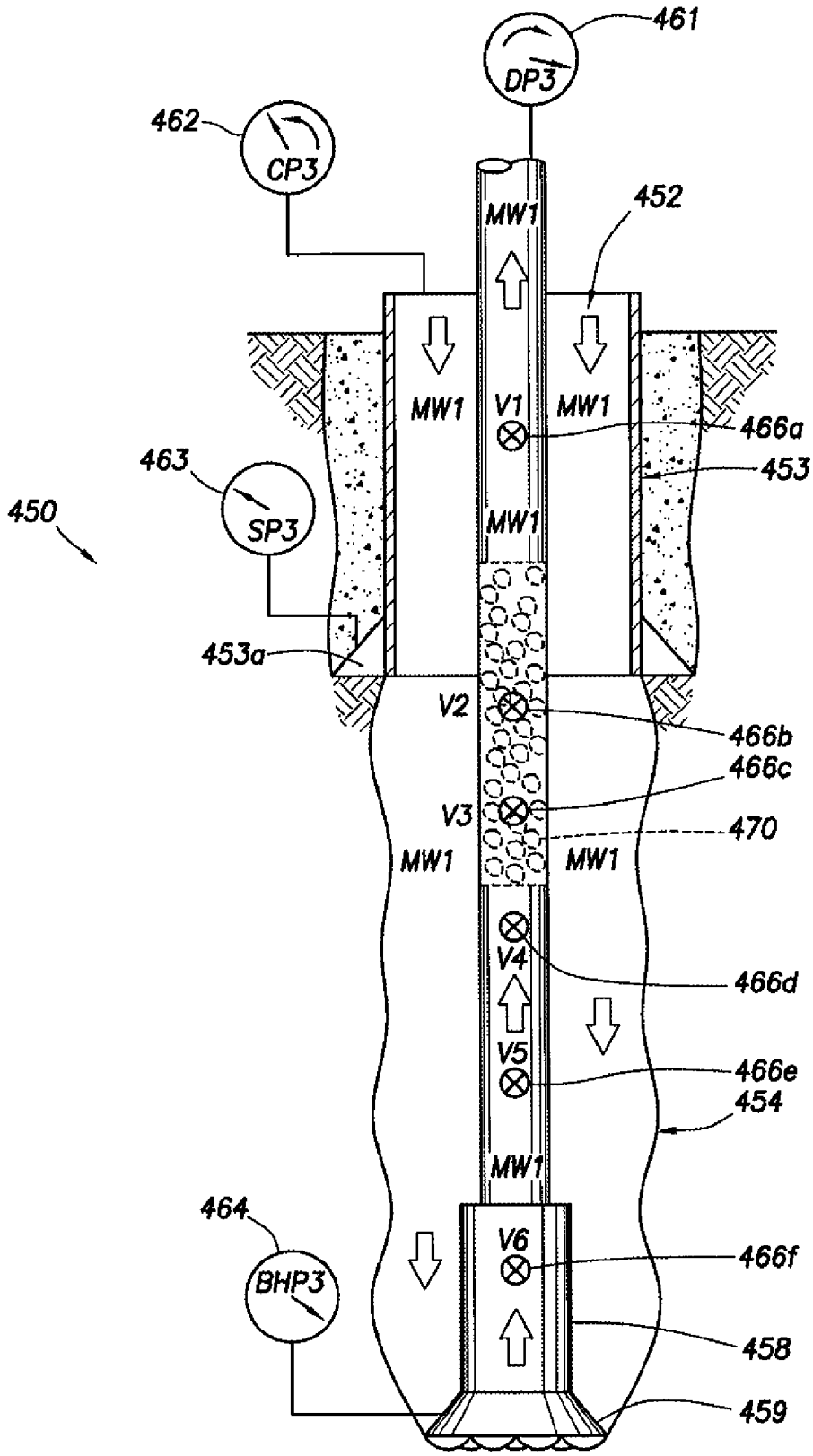
FIG. 4D shows a schematic of an example wellbore with an influx.

The final circulating pressure ("FCP") while reverse circulating should be at or just above the SIDPP prior to opening the valve, shown in step 418 on FIG. 4A. After the influx has been transferred to the drill string via valve 466*d*, the influx may be circulated to the surface. This may be accomplished using one of several options. First, the valve 466*d* may be kept open, and the circulation may continue through valve 466*d* (this would omit step 424 in FIG. 4A). Second, the valve 466*d* may be closed (step 426 in FIG. 4A), and another drill string valve (e.g., valve 466*f*) may be opened and circulation may be continued through the newly opened valve. Third, the valve 466*d* may be closed, and the circulation may continue through the ports in the drill bit (459 in FIG. 4D). As shown by the arrows in FIG. 4D, the circulation may flow downwardly through the annulus and may enter the drill string 456 through the drill bit 459. Other examples of circulation flow paths may be devised.

While reverse circulating, the casing pressure (462 in FIG. 4D) may be held substantially constant so that the bottom-hole pressure may be maintained constant.

Closing the valve 466*d* may be advantageous because circulation around the bottom hole assembly may reduce the risk of a stuck drill string. If reverse circulation through the bit is not possible, for example due to fear of or actual plugging of the ports or because of a check valve or float in the drill bit, it may still be possible to open any valve below the influx and continue circulating the influx to the surface through the drill string, as described above.

The next step (429 in FIG. 4A), is to shut in the well and align the choke to the casing return (430 in FIG. 4A) for the conventional circulation down the drill string and up the annulus.

Next the method may include the conventional circulation of a kill mud in accordance with the Driller's Method, at step 432. The mud may be circulated downwardly through the drill string and upwardly through the annulus until the well is filled with enough of the kill mud to kill the well.

Next, the method may include evaluating whether the well is dead, at step 434. This may include shutting in the well and measuring the drill pipe pressure and/or casing pressure, as was described with respect to steps 406 and 408, above. If the well has been killed, the method may include drilling ahead, at step 436. In other examples, instead of drilling ahead, the method may include continuing with other normal drilling operations, such as adding a section of pipe, making a survey, or other operations known in the art. If it is determined that the well has not been killed, the decision in step 434 may include returning to step 410 and repeating the steps to kill the well. The process between steps 410 and 434 may be repeated until the well has been successfully killed.

Figure 4E:
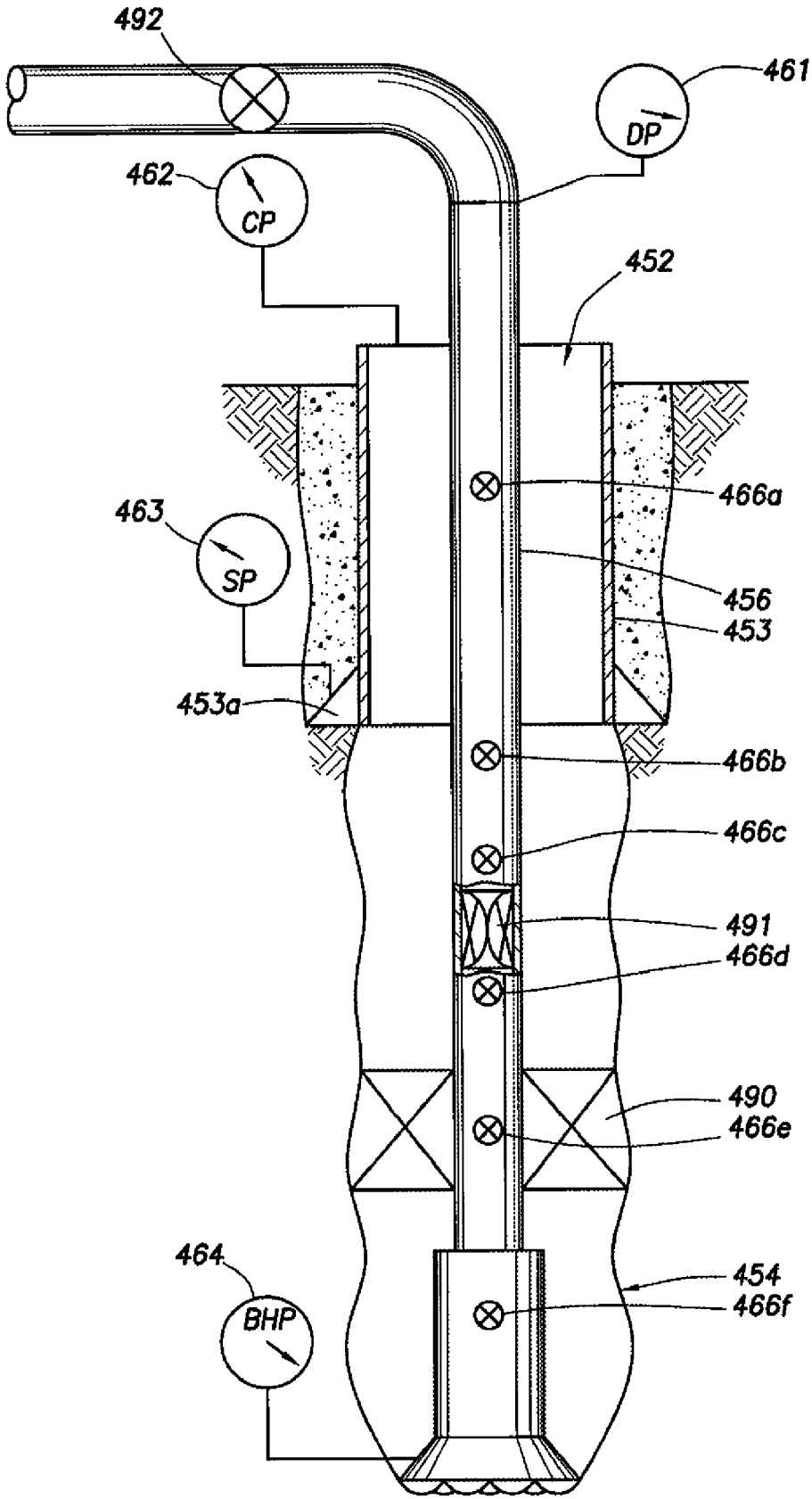
FIG. 4E shows a schematic of an example wellbore with an influx.

FIG. 4E shows a schematic with examples of packers and choke valves that may be used with one or more of the disclosed examples. In some cases, it may be desirable to limit the flow of mud when using a drill string valve 466*a-e*. For example, a packer 490 may be inflated or otherwise engaged to contact the borehole wall 454. This will prevent flow past the packer 490 in the annuls. For example, when using drill string valve 466*d*, it may be advantageous to engage the packer 490. Whether forward circulating or reverse circulating, the packer 490 will limit the flow so that it is forced to flow through valve 466*d*.

In another example, a reverse packer 491 may restrict flow within the drill string 456. For example, by engaging reverse packer 491, the downward flow through the drill string 456 may be diverted out though valve 466*c*.

It is noted that it is typical for a drill bit to include a float that prevents reverse circulation through the drill bit. Thus, in some example, reverse circulation through a drill string valve will be enhanced because the reverse flow is blocked through the bit. In such a circumstance, a packer may be omitted. In still other examples, drill string valves may be used without a packer at all. While a packer may enhance the operation of a drill string valve, it may nevertheless be omitted.

FIG. 4E also shows a choke valve 492 on the drill string 456. Such a choke valve 492 may be used to control the drill string pressure 461. Alternatively, a choke may be aligned with the casing 453, as is known in the art.

Figure 5A:
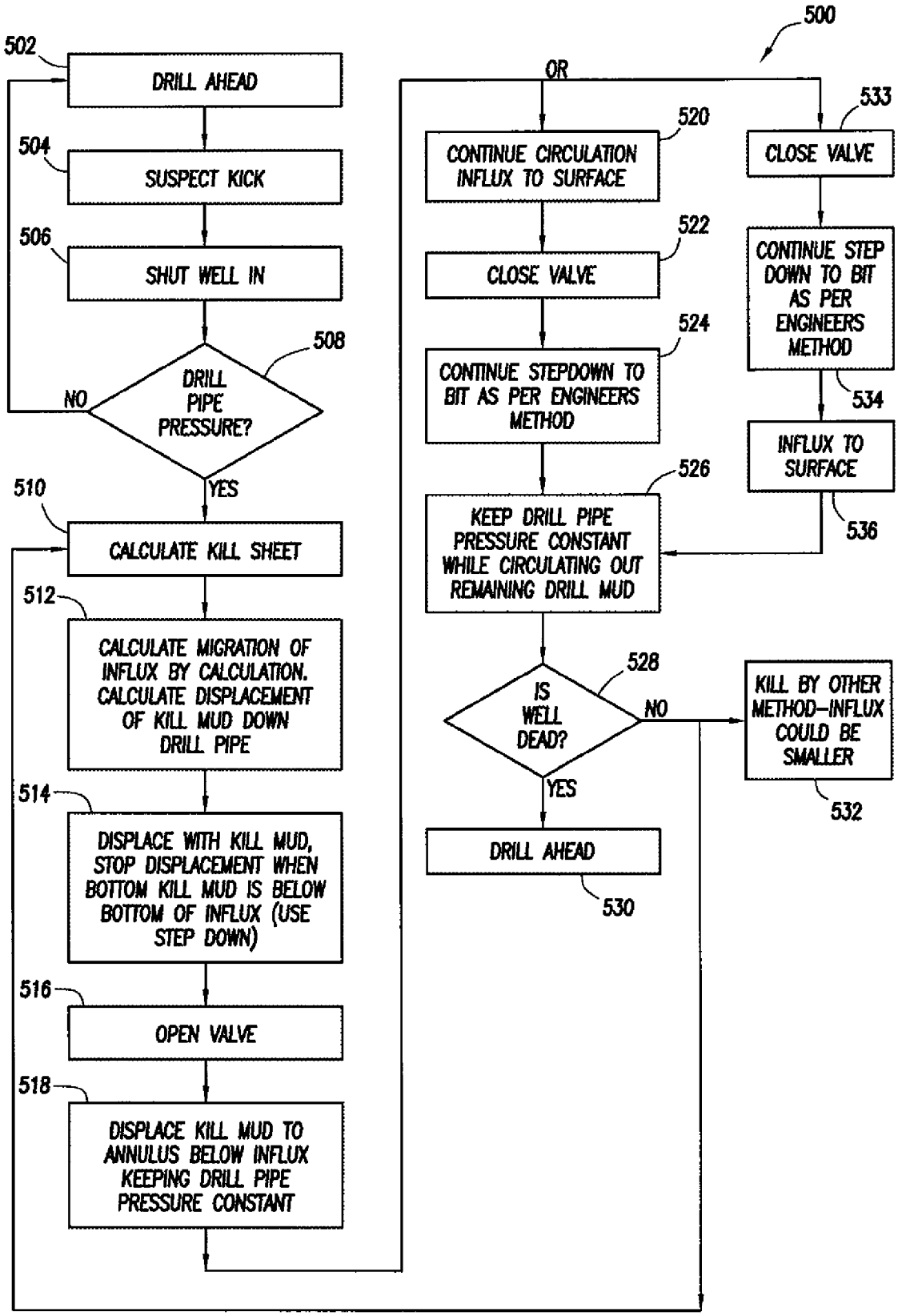
FIG. 5A shows a flow chart for an example method for controlling a well.

FIG. 5A shows another example method 500 for controlling an influx into a well. The first four steps shown in FIG. 5A, steps 502, 504, 506, and 508, are similar to steps 302, 304, 306, and 308, shown in FIG. 3A, and they may be accomplished in the same manner described above. In summary, the method includes drilling ahead (step 502) until a influx, or "kick," is suspected (step 504). The well may be shut in (step 506) and the drill pipe and casing pressures may be measured to determine if an influx has entered the well (step 508).

Figure 5B:
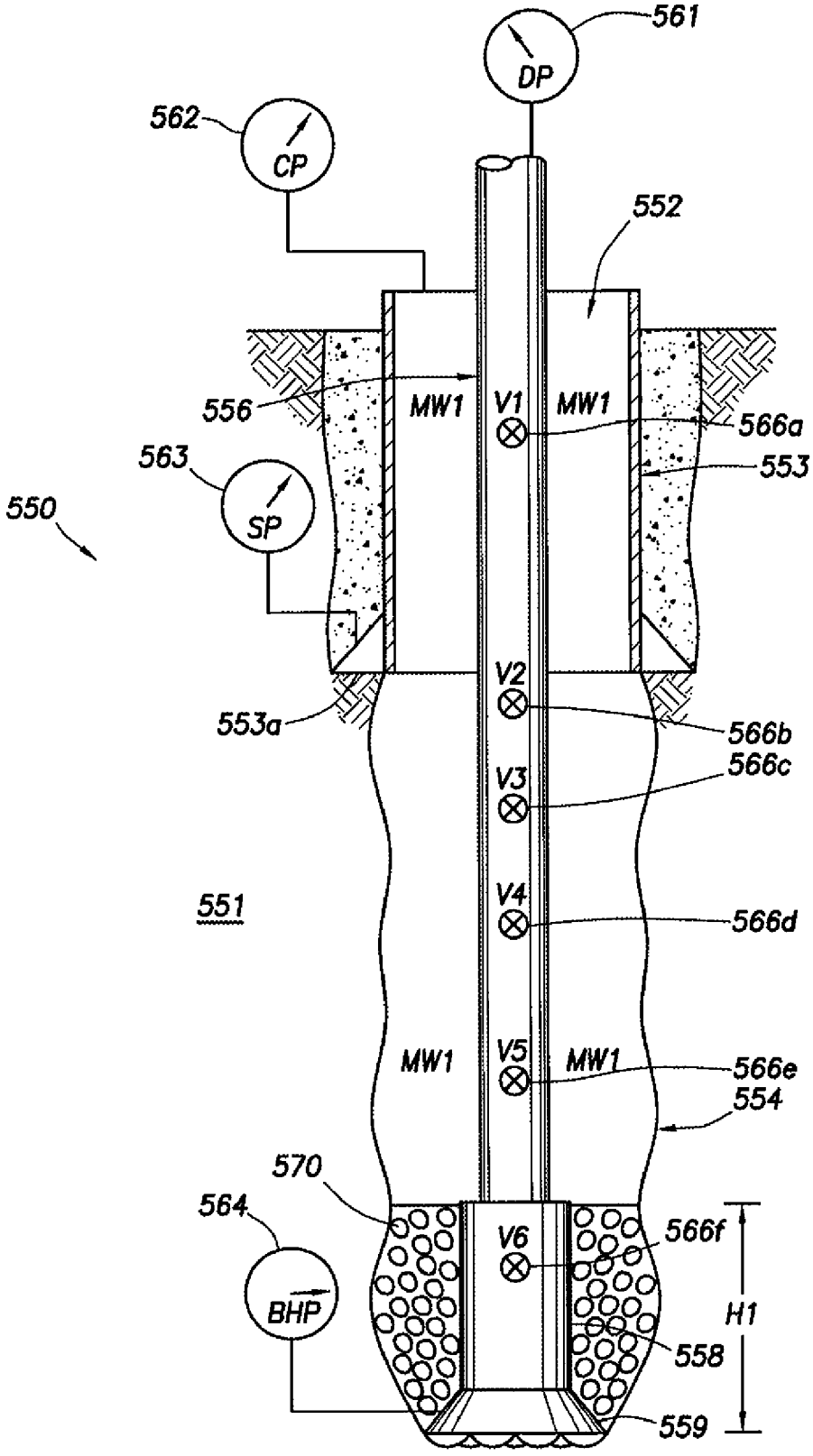
FIG. 5B shows a schematic an example wellbore with an influx.

FIG. 5B shows a schematic of a drilling operation 550 where an influx has occurred 570 and is present in the annulus near the drill bit 559. FIG. 5B shows a wellbore 552 that is being drilled by a drill string 556 having a drill bit 559 at its lower end. The drill string includes a BHA 558 and is shown with several drill string valves 566*a-f*. In one example, the drill string 556 is made up of segments of wired drill pipe, as described above.

As shown in FIG. 5B, the drill string valves 566*a-f* may be closed for typical drilling operations. The borehole 552 includes a cased section 553, with a casing shoe 553*a*, and an uncased section 554. FIG. 5B shows several pressure measurements, with representations of pressure sensors. As with FIGS. 3B-D, these representations are used to show in general where such pressure measurements may be made, but are not specifically limited to a location or any type of sensor. The pressures include a drill pipe sensor 561, a casing pressure 562, a shoe pressure 563, and a bottom-hole pressure (BHP) 564.

FIG. 5B also shows an influx 570 in the borehole 552. The influx 570 represents formation fluids, which may include liquids and gasses that had flowed into the borehole 552 from the formation 551.

Returning to FIG. 5A, the method may next include calculating a kill sheet, at step 510. The method may also include calculating the movement, or "migration," of the influx by the circulation of mud, including determining the displacement of kill mud down the drill string, at step 512. Determining both the migration of the influx and the displacement of the kill mud are shown as one step (512) because they may be interrelated, in that the amount of kill mud that is displaced will effect the migration of the influx. Nonetheless, the method should not be so limited, and persons having ordinary skill in the art will realize that separate steps may be used to determine these quantities.

Figure 5C:
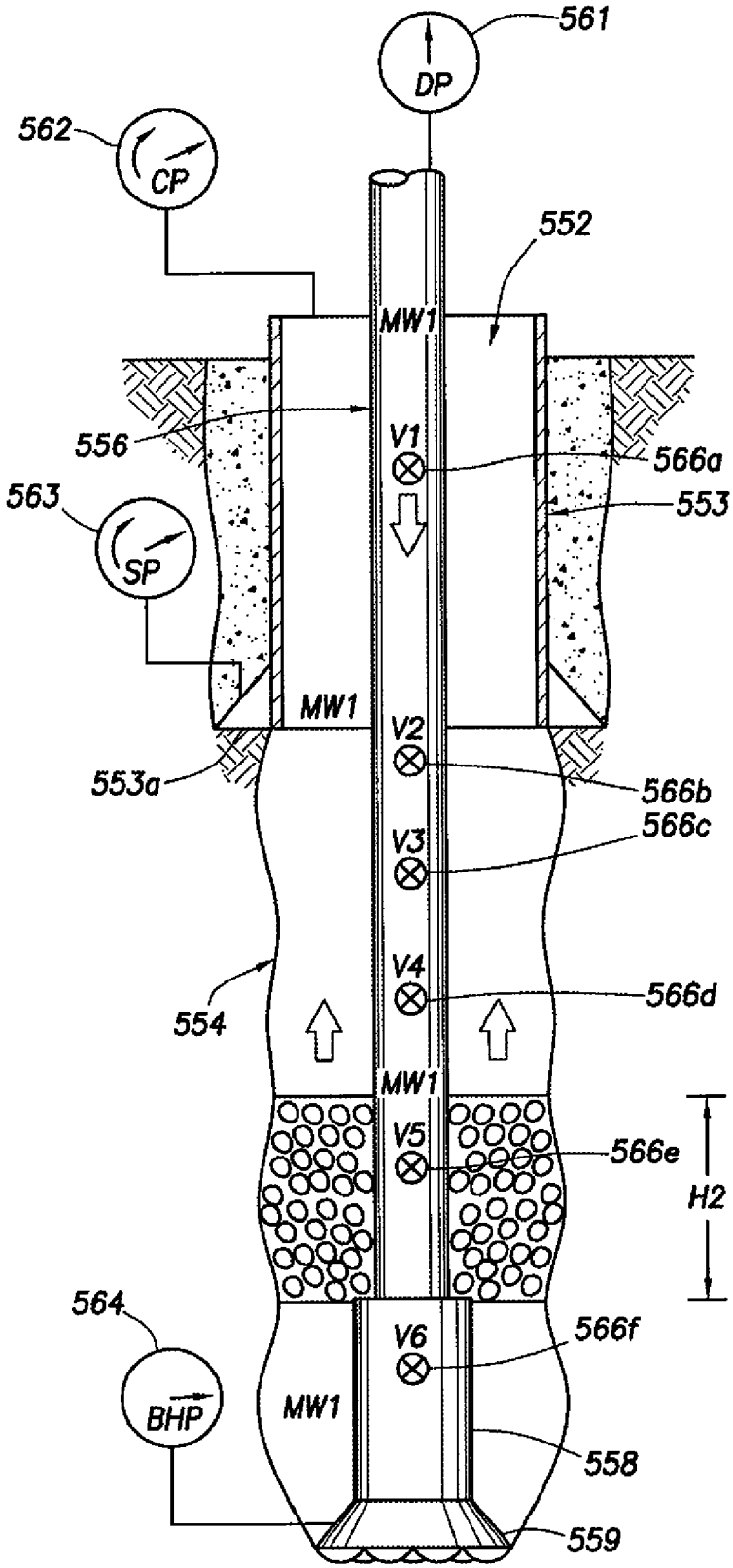
FIG. 5C shows a schematic of an example wellbore with an influx.

FIG. 5C shows the condition of the wellbore 552 while circulating drilling mud to facilitate influx placement prior to pumping kill mud. This may be performed as part of step 512. The drill pipe pressure may be held constant to maintain BHP. Depending on the influx and kill mud movement calculations, this step may be omitted and kill mud can be pumped directly as shown in FIG. 5A, 514, and FIG. 5D, using the Engineers Method.

The "Engineers Method" involves one circulation to kill the well. Once an influx is identified, the well is shut in and the entire surface system is weighted up to the required kill weight mud. Kill weight mud is then pumped from surface to bit while following a pumping stepdown schedule. Once the kill mud enters the annulus, a constant drill pipe pressure is maintained until the kill mud returns to surface.

Next the method shown in FIG. 5A includes circulating kill mud into the drill string until the kill mud has been displaced to a position that is lower than the migrated location of the influx and is adjacent a valve, at step 514. As shown in FIG. 5C, mud may be circulated down through the drill string 556, as shown by the arrows, using a step-down chart in accordance with the Engineers Method. The circulation will cause the influx 570 to migrate to a position that is no longer near the BHA 558. This may increase the annular area near the influx 570, thereby reducing its vertical height to H2, as shown in FIG. 5C. This circulation will likely cause the casing pressure 562 and the shoe pressure 563 to increase as normal/expected in well control situations by those familiar with the art.

Figure 5D:
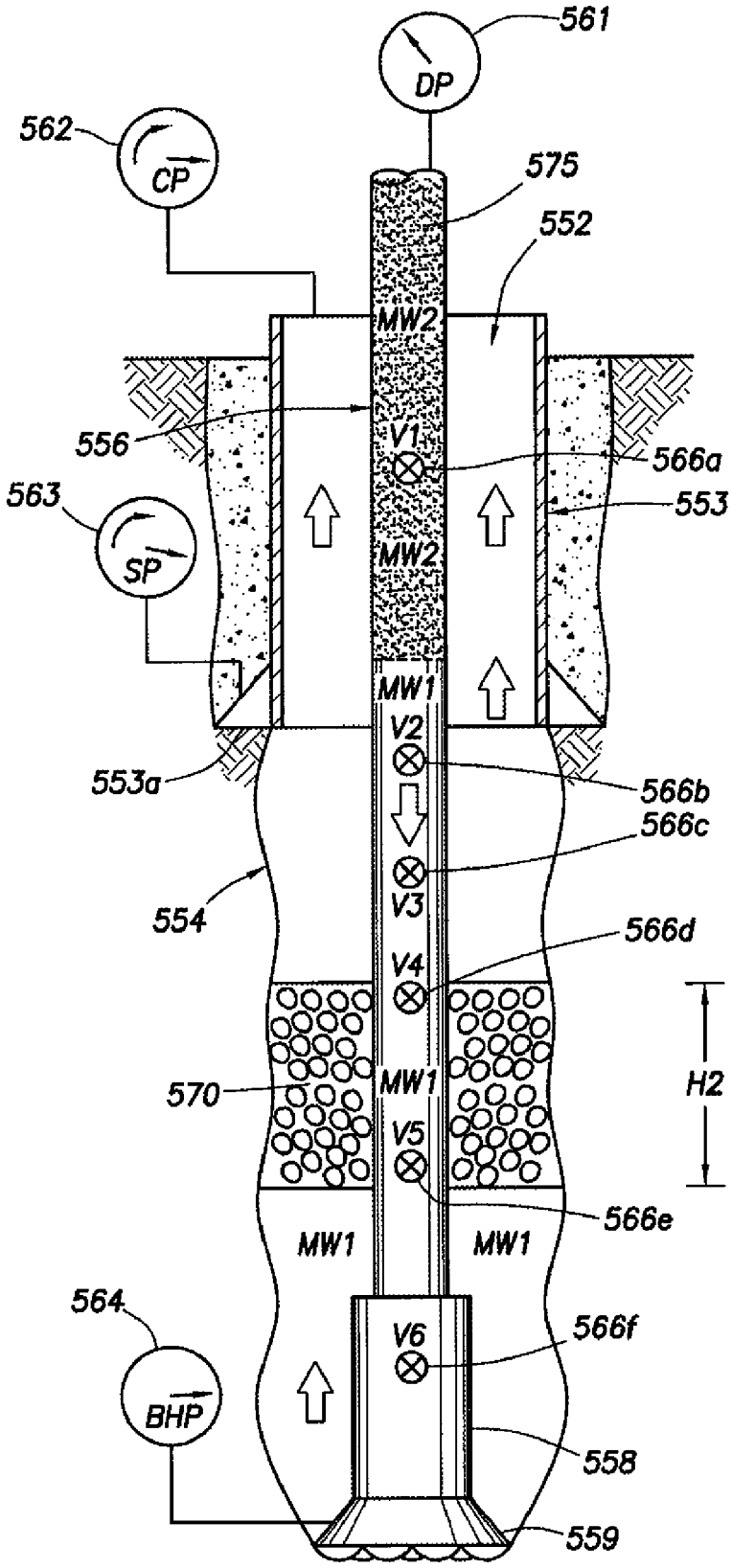
FIG. 5D shows a schematic of an example wellbore with an influx.

As shown in FIG. 5D, a kill mud 575 may be circulated downwardly through the drill string 556, also causing the upward migration of the influx 570. This circulation will also cause an increase in the casing pressure 562 and the shoe pressure 563, as the influx 570 migrates upwardly through the annulus.

Figure 5E:
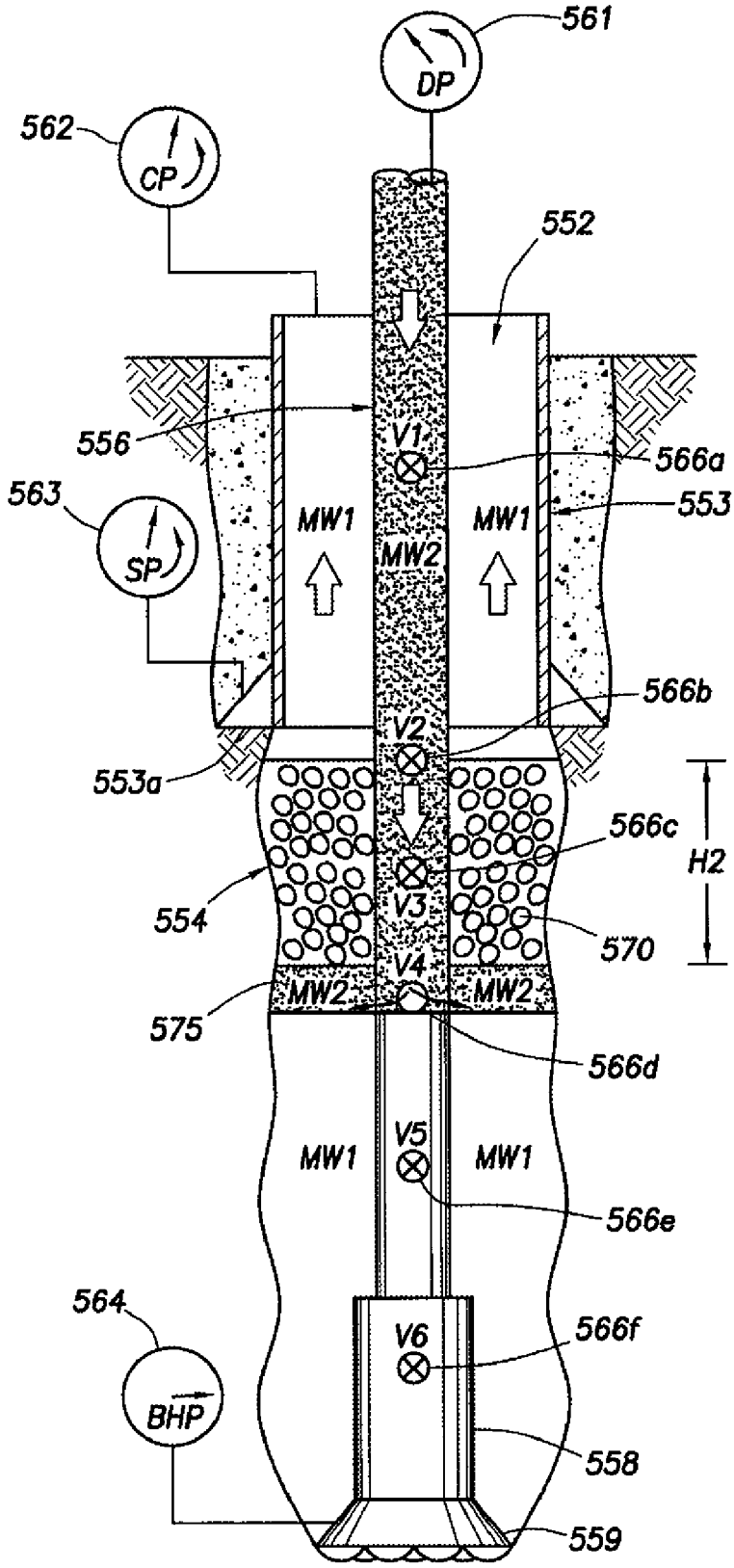
FIG. 5E shows a schematic of an example wellbore with an influx.

As shown in FIG. 5E, the kill mud 575 may be displaced until the kill mud occupies a space in the drill string 556 that is both lower than the position of the influx 570 in the annulus and adjacent a drill string valve 566*d*.

The method shown in FIG. 5A will next include opening the valve, at step 516, and displacing the kill mud into the annulus below the influx while keeping the drill pipe pressure 561 constant at the pressure achieved in the step-down table to that point in the wellbore, at step 518. FIG. 5E shows the kill mud 575 being circulated downwardly through the drill string 556 and into the annulus through drill string valve 556*d*. By selecting a valve 566*d* below the influx 570, the heavier weight kill mud 575 can be introduced into the annulus at a point below the influx 570, where it may serve one or more of the following purposes: (1) the kill mud 575 displaces the influx 570, which can be safely circulated to the surface; (2) the heavier kill mud 575 positioned below the influx 570 will cause the shoe pressure 563 and casing pressure 562 to decrease so that they are below the acceptable limits to avoid fracturing the formation below the shoe, when the influx 570 passes the shoe 553*a*; and (3) the heavier weight kill mud 575 will help to kill the well as more and more kill mud 575 is displaced into the annulus.

As shown in FIG. 5A, the method may include alternate steps that may be chosen at step 518. As shown, the method may continue by circulating the influx to the surface with the drill string valve open (step 520) and then closing the drill string valve (step 522). Alternately, the method may include closing the drill string valve (step 533), continuing the step down procedure according to the Engineer's Method (step 534), and circulating the influx to the surface (step 536). Each path will be described.

In the first option (steps 520, 522, 524), the kill mud is circulated downwardly through the drill string and out the drill string valve into the annulus. It then flows upwardly, displacing the influx until it reaches the surface, at step 520. Thus, taking the example shown in FIG. 5E, the kill mud 575 is circulated from the surface, through the drill string valve 566*d* that is positioned below the influx 570, and upwardly through the annulus, as shown by the arrows in FIG. 5E. The process continues until the influx 570 reaches the surface. Upon reaching the surface, the drill string valve 566*d* may be closed, and the kill mud may be pumped to the bottom of the drill sting 556 continuing the step-down table in accordance with the Engineers Method, where it circulates into the annulus and up to the surface to kill the well, as shown in FIG. 5F.

In the second option, valve 566*d* may be closed once a selected, and pre-calculated, amount of kill mud has been circulated into the annulus through the drill string valve, at step 533. The amount may be selected based on the predicted casing shoe pressure when the influx passes the casing shoe. Next, the method includes continuing the step down in accordance with the Engineer's Method, at step 534. The method continues until the influx is circulated to the surface, at step 536. FIG. 5E shows kill mud 575 that has been circulated into the annulus below the influx 570. Once a sufficient amount of kill mud 575 has been circulated into the annulus, the valve 556*d* may be closed. The amount of kill mud 575 circulated into the annulus may be selected by a maximum allowable shoe pressure 563 at the casing shoe 553*a*, as well as the kill mud weight and other factors that effect shoe pressure 563.

Figure 5F:
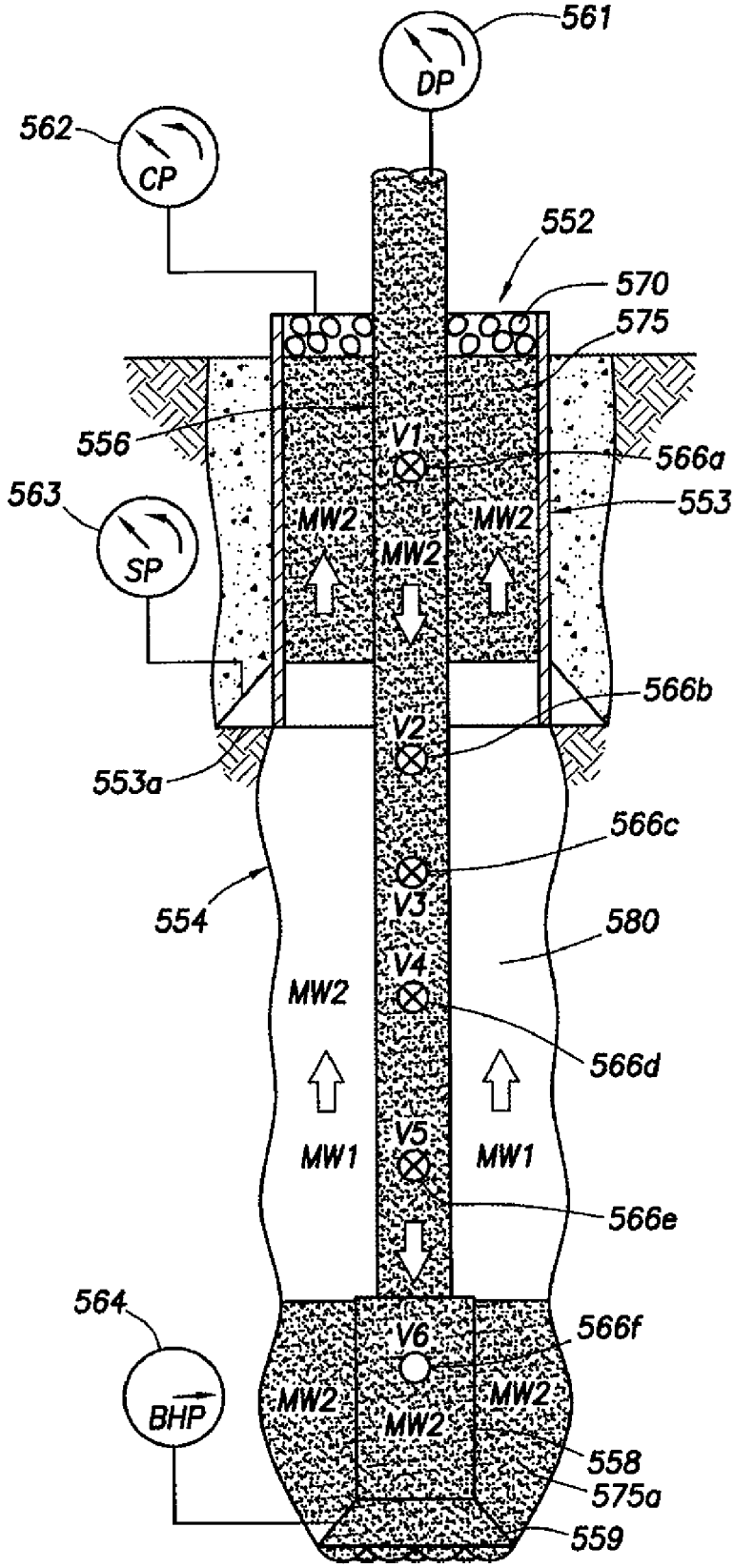
FIG. 5F shows a schematic of an example wellbore with an influx.

Once the valve 556*d* is closed, the kill mud 575 may be circulated downwardly through the drill string 556, using the step-down table, and out at the bit 559, and circulated back up through the annulus, as shown in FIG. 5F.

The two example alternate paths shown in FIG. 5A converge again at step 526, which is to maintain the drill pipe pressure (561 in FIGS. 5B-F) constant while circulating out the remaining drilling mud from the annulus. Following this step, the entire well will be filled with kill mud, and a determination may be made as to whether the well has been successfully killed, at step 528.

This may include shutting in the well and measuring the drill pipe pressure, as was described with respect to steps 506 and 508, above. If the well has been killed, the method may include drilling ahead, at step 530. If it is determined that the well has not been killed, the decision in step 528 may include returning to step 510 and repeating the steps to kill the well. The process between steps 510 and 526 may be repeated until the well has been successfully killed. Alternately, any another method, for example one of the methods shown in FIGS. 3A and 4A, may be used to kill the well, or even the conventional Driller's or Engineers method can be used if the predicted pressures at the shoe during the next kill operation are within allowable limits.

The modified Engineer's Method is particularly relevant to horizontal well control situations. The well can be effectively killed by circulating mud around the well at or just above the heel of the well. After kill mud is fully circulated above the heel of the horizontal section, the ports are closed and ports further down the string are selected and opened to allow a predetermined volume of influx to circulate to the wellbore above the heel so that surface pressures and pressures at the shoe are minimized. Port selection can get continually deeper until all of the influx and drilling weight fluid is circulated from the annulus.

Figure 7A:
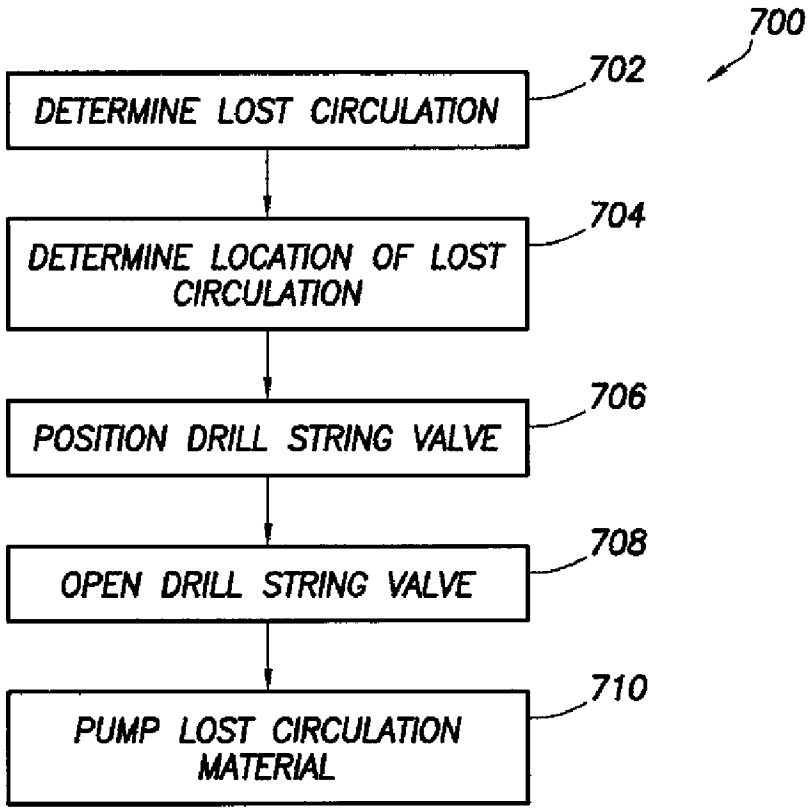
FIG. 7A is a flowchart of an example method for controlling a lost circulation zone.

FIG. 7A shows an example method 700 for plugging a lost circulation zone. In general, when lost circulation occurs, a lost circulation material ("LCM") is put in the mud and pumped into the well. The LCM in the mud may consist of any one, or in combination, of common material groups. These groups are as follows: Conventional Lost Circulation Material; (organic or inorganic—fibers, flakes, and granules), High Fluid Loss Squeezes; (diatomaceous earth or clay blends), Gunk Slurries; (Diesel Oil Bentonite to Diesel Oil Bentonite & Cement), Precipitated Chemical Slurries; (silicate and latex), Resin-Coated sand, Cross linked Polymer Slurries, Cements, Barite Plugs.

LCM materials, such as, but not limited to, those mentioned above, which are used to form a cake layer on the borehole wall and stop the lost circulation. The method includes determining that there is lost circulation, at step 702. This may be accomplished by comparing the mud pump rate to the flow rate of mud returning through the annulus. If the mud pump rate is much higher, then it is likely that there is a lost circulation zone in the wellbore, where mud is flowing into the formation, rather than returning to the surface. In another example, a lost circulation may be identified by distributed temperature and pressure measurements.

Next, the method may include determining the location of the lost circulation zone (i.e., where the mud is flowing into the formation), at step 704. In one example, this may be done using distributed pressure or temperature sensors. Pressure measurements may indicate where a drop off flow rate occurs, thereby identifying the lost circulation zone. Distributed temperature measurements may be used to identify the location of a lost circulation zone, as described above.

Next the method may include positioning a drill string valve below the lost circulation zone, at step 706, opening the drill string valve, at step 708, and pumping LCM through the drill string and out the valve, at step 710. Using this method, the LCM may be delivered to the lost circulation zone without pumping the LCM through the drill bit or any other sensitive equipment in the BHA, such as a motor. In some examples, the volume of LCM needed to seal the lost circulation zone may be estimated, and the estimated volume of LCM may be pumped down the drill string. Once the LCM has exited the drill string, the valve may be closed and drilling or other operations may be continued.

Figure 7B:
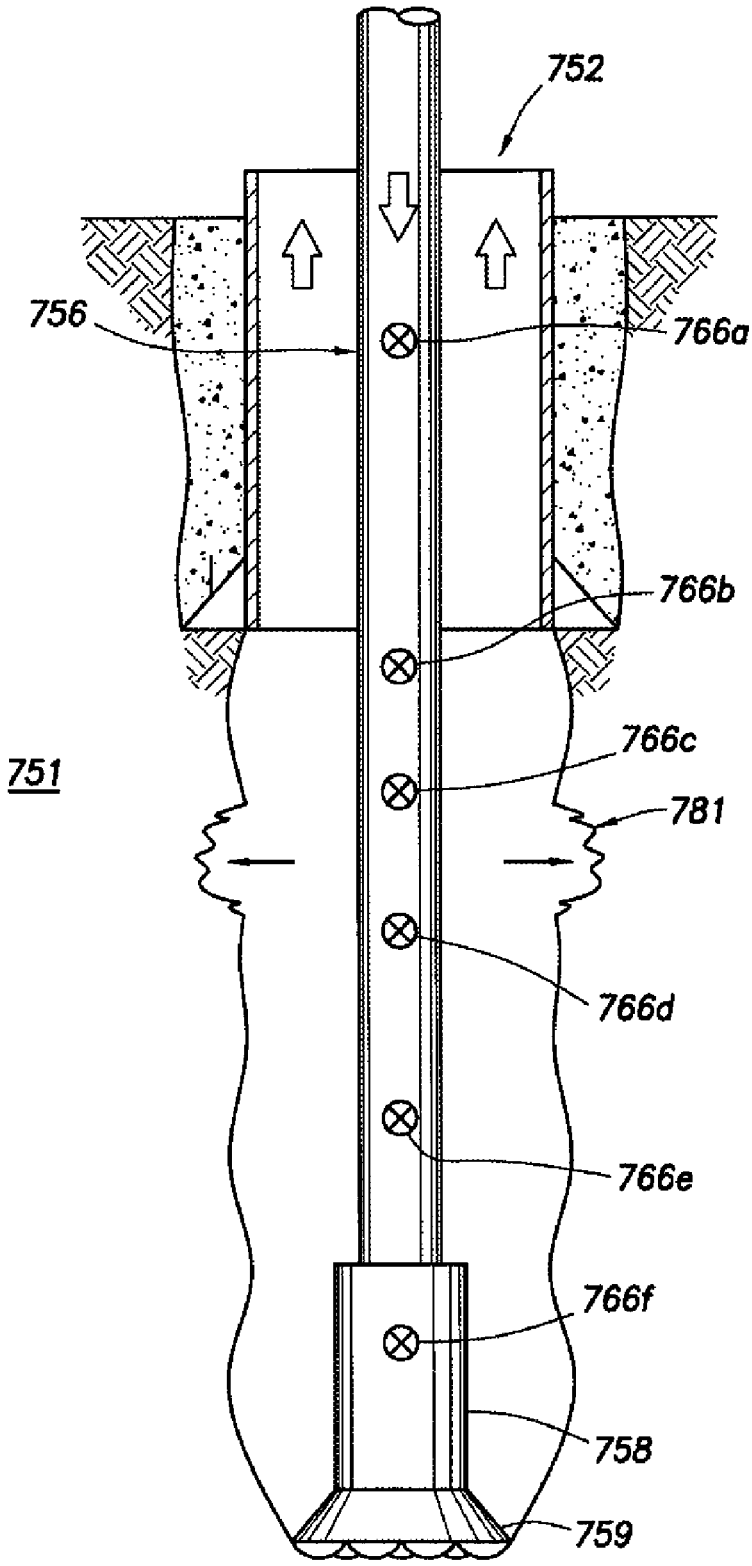
FIG. 7B shows a schematic of an example wellbore with a lost circulation zone.

FIG. 7B shows a schematic of a drilling operation with a lost circulation zone 781. FIG. 7B shows a wellbore 752 that is being drilled by a drill string 756 having a drill bit 759 at its lower end. The drill string includes a BHA 758 and is shown with several drill string valves 766*a-f*. In one example, the drill string 756 is made up of segments of wired drill pipe, as described above.

As shown in FIG. 7B, the drill string valves 766*a-f* are closed for typical drilling operations. The borehole 752 includes a cased section 753, with a casing shoe 753*a*, and an uncased section 754. FIG. 7B shows several pressure measurements, with representations of pressure sensors. As with FIGS. 3B-D, these representations are used to show in general where such pressure measurements may be made, but are not specifically limited to a location or any type of sensor.

FIG. 7B also shows a lost circulation zone 781, where mud may be flowing into the formation 751 (flow shown with arrows). The location of the lost circulation zone may be determined by distributed pressure or temperature measurements. For example, the valves 766*a-f* may be disposed in valve subs, that also include pressure and/or temperature sensors. In another example, pressure and/or temperature sensors may be distributed throughout the drill string in other ways, as are known in the art.

Figure 7C:
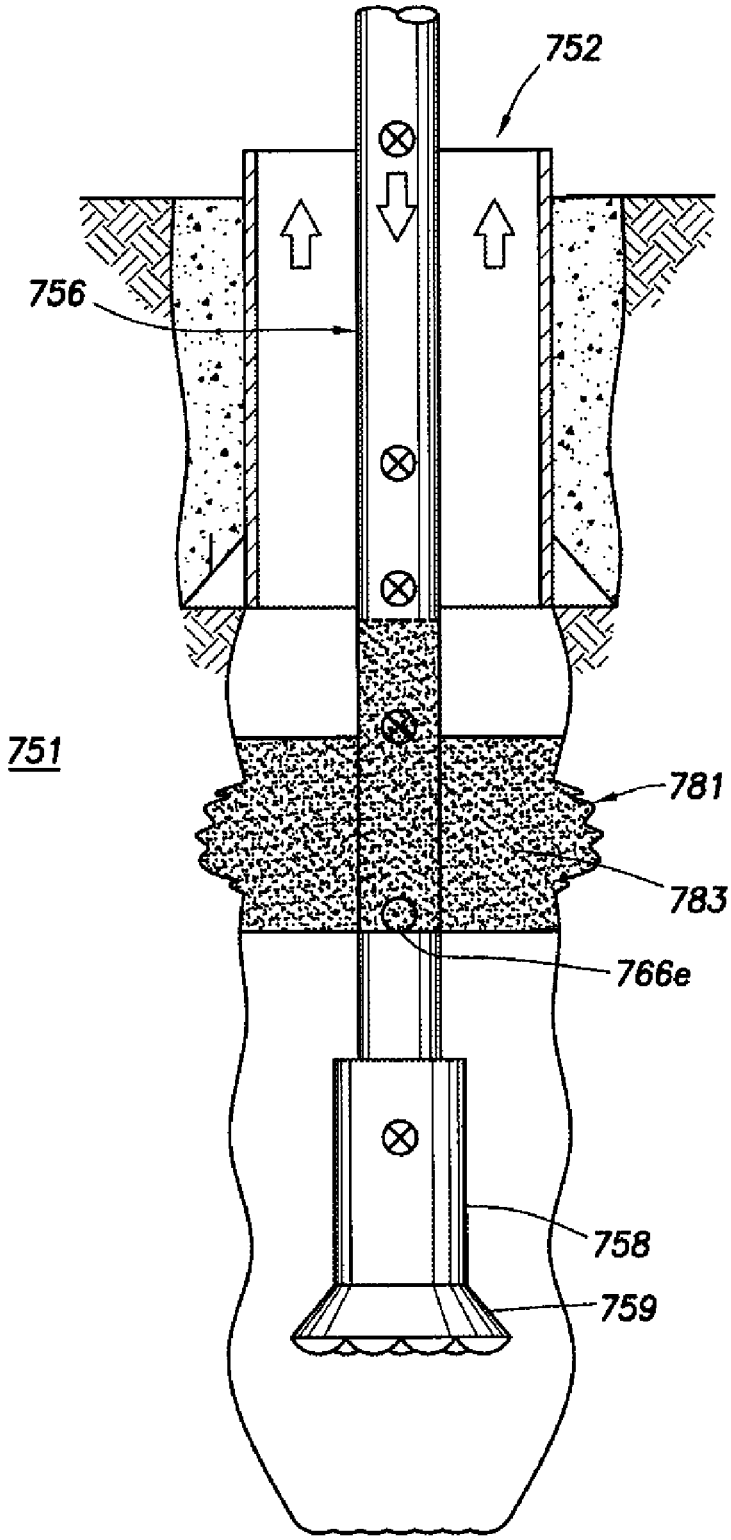
FIG. 7C shows a schematic of an example wellbore with a lost circulation zone.

Turning to FIG. 7C, once the location of the list circulation zone 781 is determined, the drill string 756 may be moved so that a drill string valve 766*e* is located below the lost circulation zone 781. LCM 783 may be pumped through the drill string 756 so that it exits the drill string 756 through the valve 766*e*.

All methods benefit from pressure and/or other sensors present on the drill string to allow the wellbore to be more completely modeled and monitored in real time. The safety factors employed in current well control techniques can be modified to allow the pressures seen in the wellbore to be identified, predicted and minimized. This may or may not be part of an automated process-feedback loop.

Any pressure sensor at or near the bit will give a direct and real-time BHP readout that can be controlled by the choke operator directly without the need for a step down schedule.

This can also be possible with automated choke/kill control systems at the surface which utilize the WDP sensor data.

The presence of distributed measurements—including temperature and pressure, will aid in other uses of the diversion valves, for instance the pressure difference between two measuring points may be indicative that cuttings are being dropped by the flow between those measuring points. Increasing the flow rate with flow diverted into that region can correct this situation. When controlling bottomhole pressure using a frictional pressure drop, it is advantageous to know the pressure change across the zone where the main frictional drop is occurring, allowing the control to be calibrated better.

While using electrically powered controllable diversion valves, as described above, a malfunction may occur, such as loss of power, which could leave valves in a position that is not preferred, i.e., open or closed. A means of shutting or opening valves, either all of the valves or specific valves in an emergency situation should be provided.

An example of a means of operating valves that does not rely on downhole power is the conventional drop-ball(s). Drop ball mechanisms are used in oil well drilling operations to typically activate downhole tools. The operation of a drop-ball may include a ball, having a diameter larger than the diameter of a yieldable seat in the downhole, being dropped from the surface through the drill string and into the downhole tool where it lands in the yieldable seat. The ball plugs the yieldable seat such that communication through the seat is interrupted. Drilling fluid pressure is then increased above the ball to displace an inner sleeve axially downward thereby activating the tool. In some situations, the shifting of the inner sleeve axially downward launches a second ball having a diameter larger than the drill string to activate further downhole equipment. Once the tool is activated, drilling fluid pressure is again increased above the first ball to force the ball through the yieldable seat and out of the tool to the bottom of the borehole. In some examples, a ball catcher may be placed below the bottom valve or the balls can be made of disintegrating material. In a preferred example, the ball catcher is a ball grinder.

Alternatively, a compliant ball can be used with a restriction in the pipe that is not affected by the valve state. At each valve, the ball is forced through by fluid flow, and the pressure drop created actuates the valve closing.

Drop-balls may also include coded radio frequency identification (RFID) tags. The RFID tags may be read by units attached to the valves as the drop-balls pass through the drillstem. The RFID tags may contain a reference number identifiable by the valve that is to be operated and a command of the valve operation (open, shut, change state). There can also be a tag that gives the same command to all, or a subset of valves.

Another means of operating valves that does not rely on power in the downhole is to include a coil along the drillpipe and to pump a magnetic ball or rod down the borehole. As the magnetic item passes through the coil, minimal electricity will be generated, which may be enough to operate the valve, for example by opening a pilot valve that then allows the difference between pipe and annular pressure to act on a valve opening mechanism.

Alternatively, a time-delay closure could be used to operate the valves. The valves could be preset on the surface to become default closed after a set time. The timer could be mechanical, electronic, or fluidic. The electronic timer could be equipped with a battery or a capacitor to store power. The fluidic timers use pressurized fluid in a chamber leaking out into the annulus. When the pressure difference increases, a mechanical device, such as a piston, will close the valve.

While the above description includes a limited number of embodiments, the specific features of one embodiment should not be attributed to other embodiments or disclosed examples. No single embodiment or example is representative of all aspects of the inventions. Moreover, variations and modifications therefrom exist. For example, other valves may be used to control or divert the flow in and around the drill string. The appended claims intend to cover all such variations and modifications.

What is claimed is:

1. A method to control borehole fluid flow comprising:
- locating at least one valve above a bottom hole assembly in a drill string;
- detecting a drilling condition;
- positioning an influx or kick above the at least one valve;
- operating the at least one valve in the drill string to place an exterior of the drill string in fluid communication with an interior of the drill string in response to detecting the drilling condition; and
- moving at least a portion of the influx or kick into the drill string through the at least one valve.

2. The method of claim 1, wherein the drilling condition is the influx or the kick and wherein detecting the influx or the kick comprises:
- shutting in the borehole; and
- measuring at least one of a drill pipe pressure and a casing pressure.

3. The method of claim 1, wherein the drilling condition is a change in pressure or temperature.

4. The method of claim 1, wherein the drilling condition is the influx or the kick, and further comprising detecting the drilling condition for a plurality of distributed temperature measurements.

5. The method of claim 1, further comprising stopping circulation of drilling fluid upon the detection of the drilling condition.

6. A method of controlling fluid flow in a borehole, comprising:
- detecting an influx of formation fluids into the borehole;
- circulating mud through the borehole;
- positioning the influx proximate a drill string valve selected from a plurality of drill string valve located along a drill string positioned in the borehole;
- opening the drill string valve; and
- circulating mud until at least a portion of the influx is circulated into an interior of the drill string.

7. The method of claim 6, wherein circulating mud through the borehole comprises using the Driller's Method, in accordance with a calculated kill sheet.

8. The method of claim 6, further comprising, prior to operating the valve, connecting the drill string to a choke valve.

9. The method of claim 6, wherein circulating mud comprises holding a drill string pressure substantially constant.

10. The method of claim 6, wherein positioning the influx proximate a drill string valve comprises positioning the drill string valve below the influx.

11. A method for controlling fluid flow in a borehole, comprising:
- detecting an influx of formation fluids into the borehole;
- selecting a proximate drill string valve from a plurality of drill string valves located along a drill string in the borehole;
- circulating mud in the borehole;
- positioning the influx above the proximate drill string valve;
- opening the proximate drill string valve;

reverse circulating the influx into the drill string through the proximate drill string valve;

closing the proximate drill string valve;

reverse circulating down annulus to circulate the influx to surface through the drill string; and circulating a kill mud.

12. The method of claim 11, wherein circulating mud through the borehole and circulating the kill mud comprises using the Driller's Method, in accordance with a calculated kill sheet.

13. The method of claim 11, further comprising, prior to operating the proximate drill string valve, connecting the drill string to a choke valve.

14. The method of claim 11, wherein circulating mud comprises holding a drill string pressure substantially constant.

15. The method of claim 11, wherein reverse circulating the influx into the drill string comprises holding a drill string pressure substantially constant.

* * * * *